US008807219B2

(12) United States Patent
Springett et al.

(10) Patent No.: US 8,807,219 B2
(45) **Date of Patent: *Aug. 19, 2014**

(54) BLOWOUT PREVENTER BLADE ASSEMBLY AND METHOD OF USING SAME

(75) Inventors: Frank Benjamin Springett, Spring, TX (US); Christopher Dale Johnson, Cypress, TX (US); Shern Eugene Peters, Houston, TX (US); Eric Trevor Ensley, Cypress, TX (US)

(73) Assignee: National Oilwell Varco, L.P., Houston, TX (US)

( * ) Notice: Subject to any disclaimer, the term of this patent is extended or adjusted under 35 U.S.C. 154(b) by 392 days.

This patent is subject to a terminal disclaimer.

(21) Appl. No.: 13/247,517

(22) Filed: Sep. 28, 2011

(65) Prior Publication Data

US 2012/0073816 A1 Mar. 29, 2012

Related U.S. Application Data

(60) Provisional application No. 61/387,805, filed on Sep. 29, 2010.

(51) Int. Cl.
*E21B 33/06* (2006.01)

(52) U.S. Cl.
CPC ..... *E21B 33/063* (2013.01)
USPC ..... 166/298; 166/55; 166/85.4; 166/85.5; 166/361; 251/1.1; 251/1.2; 251/1.3

(58) Field of Classification Search
CPC ..... E21B 33/063; E21B 33/06; E21B 33/062; E21B 21/10; E21B 29/08
USPC ..... 166/55, 298, 85.4, 85.5, 361; 251/1.1, 251/1.2, 1.3
See application file for complete search history.

(56) References Cited

U.S. PATENT DOCUMENTS

| | | | |
|---|---|---|---|
| 2,178,698 | A | 11/1939 | Penick et al. |
| 2,231,613 | A | 2/1941 | Burke |
| 2,304,793 | A | 12/1942 | Bodine, Jr. |
| 2,592,197 | A | 4/1952 | Schweitzer |
| 2,752,119 | A | 6/1956 | Allen et al. |
| 3,040,611 | A | 6/1962 | Tournaire |

(Continued)

FOREIGN PATENT DOCUMENTS

| | | |
|---|---|---|
| WO | 2006058244 | 6/2006 |
| WO | 2007024372 | 3/2007 |

OTHER PUBLICATIONS

Examination Report for European Patent Application No. EP11770145.8 dated Jul. 30, 2013, 4 pages.

(Continued)

*Primary Examiner* — Jennifer H Gay
*Assistant Examiner* — George Gray
(74) *Attorney, Agent, or Firm* — JL Salazar Law Firm

(57) ABSTRACT

A blade assembly of a blowout preventer for shearing a tubular of a wellbore penetrating a subterranean formation is provided. The blowout preventer has a housing with a hole therethrough for receiving the tubular. The blade assembly includes a ram block movable between a non-engagement position and an engagement position about the tubular, a blade carried by the ram block for cuttingly engaging the tubular, a retractable guide carried by the ram block and slidably movable therealong, and a release mechanism for selectively releasing the guide to move between a guide position for guiding engagement with the tubular and a cutting position a distance behind the blade for permitting the blade to cuttingly engage the tubular.

37 Claims, 25 Drawing Sheets

(56) References Cited

U.S. PATENT DOCUMENTS

| | | | |
|---|---|---|---|
| 3,272,222 | A | 9/1966 | Allen et al. |
| 3,399,728 | A | 9/1968 | Taylor |
| 3,554,278 | A | 1/1971 | Reistle, III et al. |
| 3,554,480 | A | 1/1971 | Rowe |
| 3,561,526 | A | 2/1971 | Williams et al. |
| 3,647,174 | A | 3/1972 | LeRouax |
| 3,670,761 | A | 6/1972 | LeRouax |
| 3,716,068 | A | 2/1973 | Addison |
| 3,741,296 | A | 6/1973 | Murman et al. |
| 3,744,749 | A | 7/1973 | LeRouax |
| 3,766,979 | A | 10/1973 | Petrick |
| 3,863,667 | A | 2/1975 | Ward |
| 3,918,478 | A | 11/1975 | LeRouax |
| 3,922,780 | A | 12/1975 | Green |
| 3,946,806 | A | 3/1976 | Meynier, III |
| 3,955,622 | A | 5/1976 | Jones |
| 4,007,797 | A | 2/1977 | Jeter |
| 4,043,389 | A | 8/1977 | Cobb |
| 4,057,887 | A | 11/1977 | Jones et al. |
| 4,119,115 | A | 10/1978 | Carruthers et al. |
| 4,132,265 | A | 1/1979 | Williams, Jr. |
| 4,132,267 | A | 1/1979 | Jones |
| 4,140,041 | A | 2/1979 | Frelau |
| 4,215,749 | A | 8/1980 | Dare et al. |
| 4,220,206 | A | 9/1980 | Van Winkle |
| 4,253,638 | A | 3/1981 | Troxell, Jr. |
| 4,313,496 | A | 2/1982 | Childs et al. |
| 4,341,264 | A | 7/1982 | Cox et al. |
| 4,347,898 | A | 9/1982 | Jones |
| 4,372,527 | A | 2/1983 | Rosenhauch et al. |
| 4,392,633 | A | 7/1983 | Van Winkle |
| 4,416,441 | A | 11/1983 | Van Winkle |
| 4,437,643 | A | 3/1984 | Brakhage, Jr. et al. |
| 4,492,359 | A | 1/1985 | Baugh |
| 4,504,037 | A | 3/1985 | Beam et al. |
| 4,508,313 | A | 4/1985 | Jones |
| 4,516,598 | A | 5/1985 | Stupak |
| 4,518,144 | A | 5/1985 | Vicic et al. |
| 4,519,577 | A | 5/1985 | Jones |
| 4,523,639 | A | 6/1985 | Howard |
| 4,526,339 | A | 7/1985 | Miller |
| 4,537,250 | A | 8/1985 | Troxell, Jr. |
| 4,540,046 | A | 9/1985 | Granger et al. |
| 4,550,895 | A | 11/1985 | Shaffer |
| 4,558,842 | A | 12/1985 | Peil et al. |
| 4,612,983 | A | 9/1986 | Karr, Jr. |
| 4,646,825 | A | 3/1987 | Van Winkle |
| 4,647,002 | A | 3/1987 | Crutchfield |
| 4,690,033 | A | 9/1987 | Van Winkle |
| 4,690,411 | A | 9/1987 | Van Winkle |
| 4,699,350 | A | 10/1987 | Herve |
| 4,923,005 | A | 5/1990 | Laky et al. |
| 4,923,008 | A | 5/1990 | Wachowicz et al. |
| 4,943,031 | A | 7/1990 | Van Winkle |
| 4,969,390 | A | 11/1990 | Williams, III |
| 5,002,130 | A | 3/1991 | Laky et al. |
| 5,013,005 | A | 5/1991 | Nance |
| 5,025,708 | A | 6/1991 | Smith et al. |
| 5,056,418 | A | 10/1991 | Granger et al. |
| 5,178,215 | A | 1/1993 | Yenulis et al. |
| 5,199,493 | A | 4/1993 | Sodder, Jr. |
| 5,217,073 | A | 6/1993 | Bruns |
| 5,237,899 | A | 8/1993 | Schartinger |
| 5,360,061 | A | 11/1994 | Womble |
| 5,361,832 | A | 11/1994 | Van Winkle |
| 5,400,857 | A | 3/1995 | Whitby et al. |
| 5,505,426 | A | 4/1996 | Whitby et al. |
| 5,515,916 | A | 5/1996 | Haley |
| 5,566,753 | A | 10/1996 | VanWinkle |
| 5,575,451 | A | 11/1996 | Colvin et al. |
| 5,575,452 | A | 11/1996 | Whitby et al. |
| 5,588,491 | A | 12/1996 | Brugman et al. |
| 5,590,867 | A | 1/1997 | Van Winkle |
| 5,655,745 | A | 8/1997 | Morill |
| 5,662,171 | A | 9/1997 | Brugman et al. |
| 5,735,502 | A | 4/1998 | Levett et al. |
| 5,778,918 | A | 7/1998 | McLelland |
| 5,863,022 | A | 1/1999 | Van Winkle |
| 5,897,094 | A | 4/1999 | Brugman et al. |
| 5,918,851 | A | 7/1999 | Whitby |
| 5,961,094 | A | 10/1999 | Van Winkle |
| 5,975,484 | A | 11/1999 | Brugman et al. |
| 6,006,647 | A | 12/1999 | Van Winkle |
| 6,012,528 | A | 1/2000 | Van Winkle |
| 6,016,880 | A | 1/2000 | Hall et al. |
| 6,113,061 | A | 9/2000 | Van Winkle |
| 6,158,505 | A | 12/2000 | Araujo |
| 6,164,619 | A | 12/2000 | Van Winkle et al. |
| 6,173,770 | B1 | 1/2001 | Morrill |
| 6,192,680 | B1 | 2/2001 | Brugman et al. |
| 6,244,336 | B1 | 6/2001 | Kachich |
| 6,276,450 | B1 | 8/2001 | Seneviratne |
| 6,374,925 | B1 | 4/2002 | Elkins et al. |
| 6,484,808 | B2 | 11/2002 | Jones et al. |
| 6,510,897 | B2 | 1/2003 | Hemphill |
| 6,530,432 | B2 | 3/2003 | Gipson |
| 6,601,650 | B2 | 8/2003 | Sundararajan |
| 6,718,860 | B2 | 4/2004 | Mitsukawa et al. |
| 6,719,042 | B2 | 4/2004 | Johnson et al. |
| 6,742,597 | B2 | 6/2004 | Van Winkle et al. |
| 6,834,721 | B2 | 12/2004 | Suro |
| 6,843,463 | B1 | 1/2005 | McWhorter et al. |
| 6,857,634 | B2 | 2/2005 | Araujo |
| 6,964,303 | B2 | 11/2005 | Mazorow et al. |
| 6,969,042 | B2 | 11/2005 | Gaydos |
| 6,974,135 | B2 | 12/2005 | Melancon et al. |
| 7,011,159 | B2 | 3/2006 | Holland |
| 7,011,160 | B2 | 3/2006 | Boyd |
| 7,044,430 | B2 | 5/2006 | Brugman et al. |
| 7,051,989 | B2 | 5/2006 | Springett et al. |
| 7,051,990 | B2 | 5/2006 | Springett et al. |
| 7,055,594 | B1 | 6/2006 | Springett et al. |
| 7,086,467 | B2 | 8/2006 | Schlegelmilch et al. |
| 7,108,081 | B2 | 9/2006 | Boyadjieff |
| 7,165,619 | B2 | 1/2007 | Fox et al. |
| 7,181,808 | B1 | 2/2007 | Van Winkle |
| 7,195,224 | B2 | 3/2007 | Le |
| 7,207,382 | B2 | 4/2007 | Schaeper |
| 7,225,873 | B2 | 6/2007 | Schlegelmilch et al. |
| 7,234,530 | B2 | 6/2007 | Gass |
| 7,243,713 | B2 | 7/2007 | Isaacks et al. |
| 7,270,190 | B2 | 9/2007 | McWhorter et al. |
| 7,287,544 | B2 | 10/2007 | Seneviratne et al. |
| 7,331,562 | B2 | 2/2008 | Springett |
| 7,350,587 | B2 | 4/2008 | Springett et al. |
| 7,354,026 | B2 | 4/2008 | Urrutia |
| 7,360,603 | B2 | 4/2008 | Springett et al. |
| 7,367,396 | B2 | 5/2008 | Springett et al. |
| 7,389,817 | B2 | 6/2008 | Almdahl et al. |
| 7,410,003 | B2 | 8/2008 | Ravensbergen et al. |
| 7,434,369 | B2 | 10/2008 | Uneyama et al. |
| 7,464,765 | B2 | 12/2008 | Isaacks et al. |
| 7,487,848 | B2 | 2/2009 | Wells et al. |
| 7,520,129 | B2 | 4/2009 | Springett |
| 7,523,644 | B2 | 4/2009 | Van Winkle |
| 7,673,674 | B2 | 3/2010 | Lam |
| 7,703,739 | B2 | 4/2010 | Judge et al. |
| 7,726,418 | B2 | 6/2010 | Ayling |
| 7,748,473 | B2 | 7/2010 | Wells et al. |
| 7,798,466 | B2 | 9/2010 | Springett et al. |
| 7,814,979 | B2 | 10/2010 | Springett et al. |
| 7,926,501 | B2 | 4/2011 | Springett et al. |
| 2004/0124380 | A1 | 7/2004 | Van Winkle |
| 2006/0076526 | A1 | 4/2006 | McWhorter et al. |
| 2007/0137866 | A1 | 6/2007 | Ravensbergen et al. |
| 2008/0040070 | A1 | 2/2008 | McClanahan |

(56) References Cited

U.S. PATENT DOCUMENTS

| | | | |
|---|---|---|---|
| 2008/0189954 | A1 | 8/2008 | Lin |
| 2008/0267786 | A1 | 10/2008 | Springett et al. |
| 2009/0056132 | A1 | 3/2009 | Foote |
| 2009/0205838 | A1 | 8/2009 | Springett |
| 2010/0038088 | A1 | 2/2010 | Springett et al. |

OTHER PUBLICATIONS

Response to Examination Report for European Patent Application No. EP11770145.8 dated Oct. 9, 2013, 7 pages.

International Preliminary Report on Patentability for PCT Patent Application No. PCT/GB2011/051853 dated Apr. 2, 2013, 6 pages.

International Search Report for PCT Application No. PCT/GB2011/051852 dated Jan. 22, 2013, 4 pages.

BLOWOUT PREVENTER BLADE ASSEMBLY AND METHOD OF USING SAME

CROSS-REFERENCE TO RELATED APPLICATION

This application claims the benefit of U.S. Provisional Application No. 61/387,805, filed Sep. 29, 2010, the entire contents of which are hereby incorporated by reference.

BACKGROUND

1. Field

The present invention relates generally to techniques for performing wellsite operations. More specifically, the present invention relates to techniques, such as a tubular centering device and/or a blowout preventer (BOP).

2. Description of Related Art

Oilfield operations are typically performed to locate and gather valuable downhole fluids. Oil rigs may be positioned at wellsites and downhole tools, such as drilling tools, may be deployed into the ground to reach subsurface reservoirs. Once the downhole tools form a wellbore to reach a desired reservoir, casings may be cemented into place within the wellbore, and the wellbore completed to initiate production of fluids from the reservoir. Tubulars or tubular strings may be positioned in the wellbore to enable the passage of subsurface fluids from the reservoir to the surface.

Leakage of subsurface fluids may pose an environmental threat if released from the wellbore. Equipment, such as BOPs, may be positioned about the wellbore to form a seal about a tubular therein, for example, to prevent leakage of fluid as it is brought to the surface. BOPs may have selectively actuatable rams or ram bonnets, such as tubular rams (to contact, engage, and/or encompass tubulars to seal the wellbore) or shear rams (to contact and physically shear a tubular), that may be activated to sever and/or seal a tubular in a wellbore. Some examples of ram BOPs and/or ram blocks are provided in U.S. Pat. Nos. 3,554,278; 4,647,002; 5,025,708; 7,051,989; 5,575,452; 6,374,925; 7,798,466; 5,735,502; 5,897,094 and 2009/0056132. Techniques have also been provided for cutting tubing in a BOP as disclosed, for example, in U.S. Pat. Nos. 3,946,806; 4,043,389; 4,313,496; 4,132,267; 2,752,119; 3,272,222; 3,744,749; 4,523,639; 5,056,418; 5,918,851; 5,360,061; 4,923,005; 4,537,250; 5,515,916; 6,173,770; 3,863,667; 6,158,505; 4,057,887; 5,505,426; 3,955,622; 7,234,530 and 5,013,005. Some BOPs may be provided guides as described, for example, in U.S. Pat. Nos. 5,400,857, 7,243,713 and 7,464,765.

Despite the development of techniques for cutting tubulars, there remains a need to provide advanced techniques for more effectively sealing and/or severing tubulars. The present invention is directed to fulfilling this need in the art.

SUMMARY

In at least one aspect, the subject matter may relate to a blade assembly of a blowout preventer for shearing a tubular of a wellbore penetrating a subterranean formation, the blowout preventer having a housing with a hole therethrough for receiving the tubular. The blade assembly includes a ram block movable between a non-engagement position and an engagement position about the tubular, a blade carried by the ram block for cuttingly engaging the tubular, a retractable guide carried by the ram block and slidably movable therealong, and a release mechanism for selectively releasing the guide to move between a guide position for guiding engagement with the tubular and a cutting position a distance behind the blade for permitting the blade to cuttingly engage the tubular.

The release mechanism may be activatable by application of a disconnect force to a guide surface thereof. The blade assembly may also include a trigger for activating the release mechanism. The trigger may include a plunger operatively connectable to the release mechanism. The plunger may be positioned about an apex of the guide and/or along a guide surface of the guide. The plunger may include a plurality of contacts. Each of the contacts may be operatively coupled to a member by a rod. The member may be slidably positionable in a trigger channel of the guide. The plunger may have at least one trigger guide slidably positionable in at least one trigger slot in the guide.

The release mechanism may include a member operatively coupled to the trigger and slidably positionable in a trigger channel of the guide. The release mechanism may also include a plurality of biasing members for supporting the member in the guide channel, a plurality of wedges selectively movable between a locked and unlocked position in the guide by movement of the member, and/or a plurality of bosses carried by the wedges and selectively movable along a plurality of passageways in the guide. The passageways may be in fluid communication with tubes extending through the guide for the passage of fluid therethrough. The release mechanism may include a lip positionable adjacent an edge of the ram block. The ram block may have a ramp for slidingly receiving the lip.

The guide may include a plurality of springs and the release mechanism may include a plurality of latches releaseably connectable to the plurality of springs. The latches may be pivotally connectable to the ram block for selectively engaging the plurality of springs.

The ram blocks may have guide pins receivable by guide slots in the guide for sliding movement therealong. The ram blocks may have shoulders for slidable engagement with the guide. The guide surface may be concave with an apex along a central axis thereof. The guide surface may have a first portion at a first angle to the central axis and/or a second portion at a second angle to the central axis.

In another aspect, the subject matter may relate to a blowout preventer for shearing a tubular of a wellbore penetrating a subterranean formation. The blowout preventer may include a housing with a hole therethrough for receiving the tubular and a pair of blade assemblies. Each of the blade assemblies may include a ram block movable between a non-engagement position and an engagement position about the tubular, a blade carried by the ram block for cuttingly engaging the tubular, a retractable guide carried by the ram block and slidably movable therealong, and a release mechanism for selectively releasing the guide to move between a guide position for guiding engagement with the tubular and a cutting position a distance behind the blade for permitting the blade to cuttingly engage the tubular.

The retractable guide may have a pocket for receiving a tip of another retractable guide positioned opposite thereto. The blowout preventer may also include at least one actuator for actuating the ram block of each of the blade assemblies. The release mechanism may include a trigger for activation thereof. The trigger may be activatable upon contact with the tubular and/or upon contact with another guide.

Finally in another aspect, the subject matter may relate to a method of shearing a tubular of a wellbore penetrating a subterranean formation. The method may involve providing a blowout preventer including a housing with a hole therethrough for receiving the tubular and a pair of blade assemblies. Each of the blade assemblies may include a ram block, a blade carried by the ram block, a retractable guide carried by the ram block, and a release mechanism. The method may further involve moving the ram block between a non-engagement position and an engagement position about the tubular, selectively releasing the release mechanism, slidably moving the guide between a guide position for guiding engagement with the tubular and a cutting position a distance behind the blade for permitting the blade to cuttingly engage the tubular, and cuttingly engaging the tubular with the blade.

The selectively releasing may occur on application of a disconnect force. The selectively releasing may include shifting a lip along a ramp of the ram block, unlatching the guide, triggering the release mechanism, and/or shifting the release mechanism between a locked and an unlocked position. The method may further involve guiding the tubular to a desired position in the blowout preventer with the guide.

BRIEF DESCRIPTION OF THE DRAWINGS

So that the above recited features and advantages of the present disclosure can be understood in detail, a more particular description of the disclosure, briefly summarized above, may be had by reference to the embodiments thereof that are illustrated in the appended drawings. It is to be noted, however, that the appended drawings illustrate only typical embodiments and are, therefore, not to be considered limiting of its scope, for the disclosure may admit to other equally effective embodiments. The figures are not necessarily to scale and certain features and certain views of the figures may be shown exaggerated in scale or in schematic in the interest of clarity and conciseness.

DETAILED DESCRIPTION

The description that follows includes exemplary apparatus, methods, techniques, and instruction sequences that embody techniques of the present subject matter. However, it is understood that the described embodiments may be practiced without these specific details.

The techniques herein relate to blade assemblies for blowout preventers. These blade assemblies are configured to provide tubular centering and shearing capabilities. Retractable guides and/or release mechanisms may be used to position the tubulars during shearing. It may be desirable to provide techniques for positioning the tubular prior to sever the tubular. It may be further desirable that such techniques be performed on any sized tubular, such as those having a diameter of up to about 8½" (21.59 cm) or more. Such techniques may involve one or more of the following, among others: positioning of the tubular, efficient parts replacement, reduced wear on blade, less force required to sever the tubular, efficient severing, and less maintenance time for part replacement.

Figure 1:
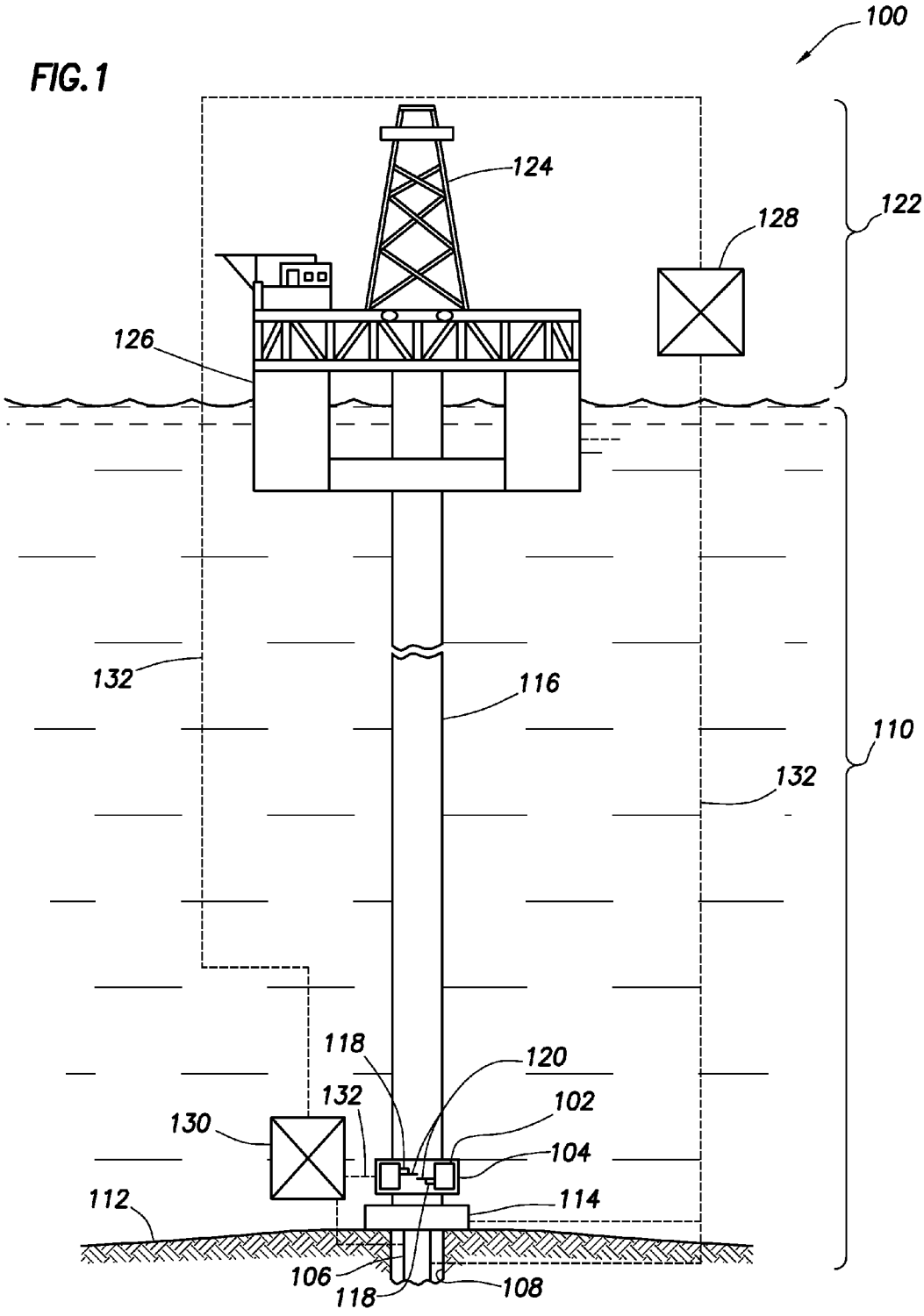
FIG. 1 is a schematic view of an offshore wellsite having a blowout preventer (BOP) with a blade assembly.

FIG. 1 depicts an offshore wellsite 100 having a blade assembly 102 in a housing 105 of a blowout preventer (BOP) 104. The blade assembly 102 may be configured to center a tubular 106 in the BOP 104 prior to or concurrently with a severing of the tubular 106. The tubular 106 may be fed through the BOP 104 and into a wellbore 108 penetrating a subterranean formation. The BOP 104 may be part of a subsea system 110 positioned on a floor 112 of the sea. The subsea system 110 may also comprise the tubular (or pipe) 106 extending from the wellbore 108, a wellhead 114 about the wellbore 108, a conduit 116 extending from the wellbore 108 and other subsea devices, such as a stripper and a conveyance delivery system (not shown).

The blade assembly 102 may have at least one tubular centering system 118 and at least one blade 120. The tubular centering system 118 may be configured to center the tubular 106 within the BOP 104 prior to and/or concurrently with the blade 120 engaging the tubular 106, as will be discussed in more detail below. The tubular centering system 118 may be coupled to, or move with, the blade 120, thereby allowing the centering of the tubular 106 without using extra actuators, or the need to machine the BOP 104 body.

While the offshore wellsite 100 is depicted as a subsea operation, it will be appreciated that the wellsite 100 may be land or water based, and the blade assembly 102 may be used in any wellsite environment. The tubular 106 may be any suitable tubular and/or conveyance for running tools into the wellbore 108, such as certain downhole tools, pipe, casing, drill tubular, liner, coiled tubing, production tubing, wireline, slickline, or other tubular members positioned in the wellbore and associated components, such as drill collars, tool joints, drill bits, logging tools, packers, and the like (referred to herein as "tubular" or "tubular strings").

A surface system 122 may be used to facilitate operations at the offshore wellsite 100. The surface system 122 may comprise a rig 124, a platform 126 (or vessel) and a surface controller 128. Further, there may be one or more subsea controllers 130. While the surface controller 128 is shown as part of the surface system 122 at a surface location, and the subsea controller 130 is shown as part of the subsea system 110 in a subsea location, it will be appreciated that one or more surface controllers 128 and subsea controllers 130 may be located at various locations to control the surface and/or subsea systems.

To operate the blade assembly 102 and/or other devices associated with the wellsite 100, the surface controller 128 and/or the subsea controller 130 may be placed in communication therewith. The surface controller 128, the subsea controller 130, and/or any devices at the wellsite 100 may communicate via one or more communication links 132. The communication links 132 may be any suitable communication system and/or device, such as hydraulic lines, pneumatic lines, wiring, fiber optics, telemetry, acoustics, wireless communication, any combination thereof, and the like. The blade assembly 102, the BOP 104, and/or other devices at the wellsite 100 may be automatically, manually, and/or selectively operated via the surface controller 128 and/or subsea controller 130.

Figure 2:
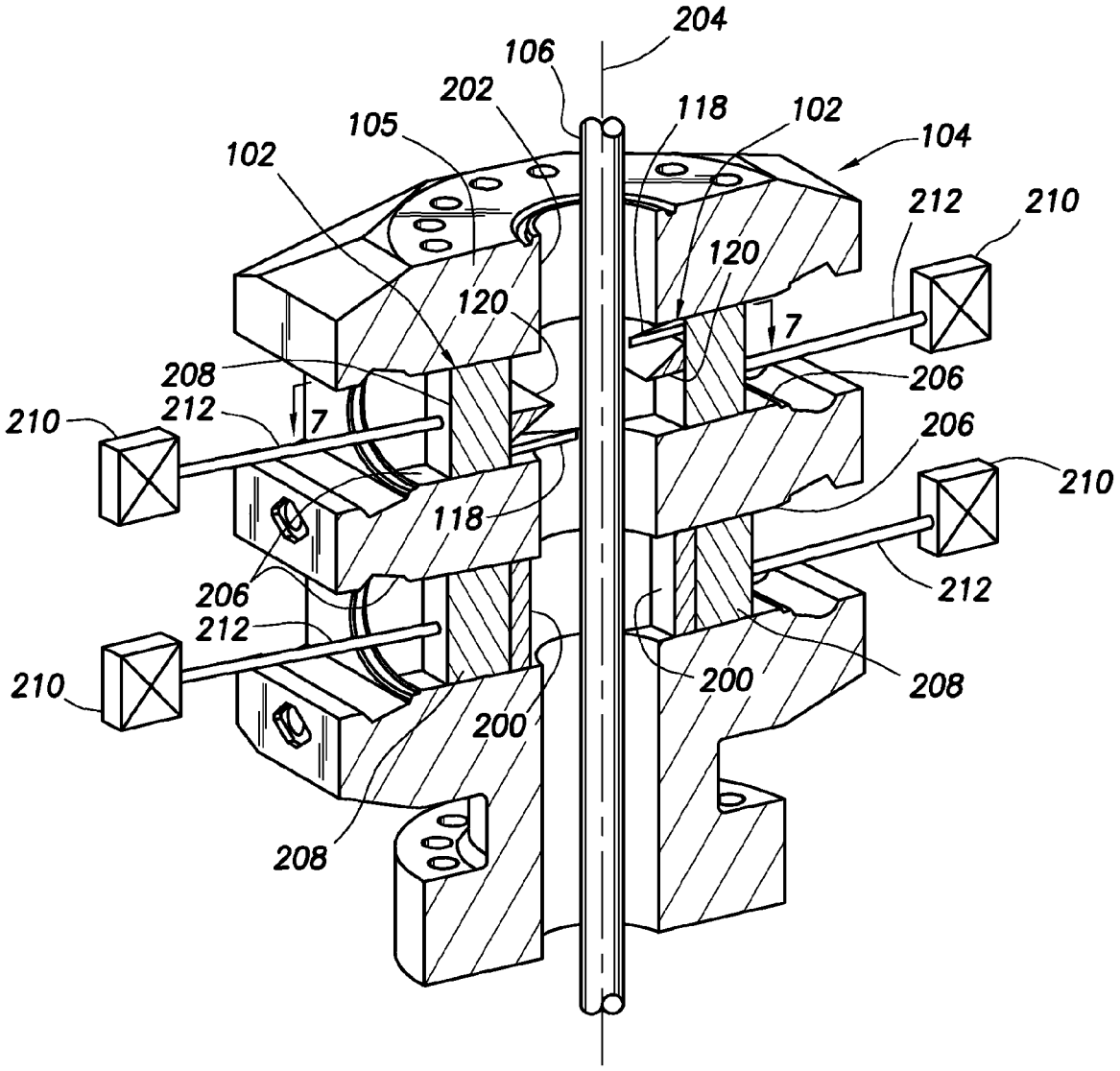
FIG. 2 is a schematic view, partially in cross-section, of the BOP of FIG. 1 prior to initiating a BOP operation.

FIG. 2 shows a schematic, cross-sectional view of the BOP 104 of FIG. 1 having the blade assembly 102 and a seal assembly 200. The BOP 104, as shown, has a hole 202 through a central axis 204 of the BOP 104. The hole 202 may be for receiving the tubular 106. The BOP 104 may have one or more channels 206 for receiving the blade assembly 102 and/or the seal assembly 200. As shown, there are two channels 206, one having the blade assembly 102 and the other having the seal assembly 200 therein. Although, there are two channels 206, it should be appreciated that there may be any number of channels 206 housing any number of blade assemblies 102 and/or seal assemblies 200. The channels 206 may be configured to guide the blade assembly 102 and/or the seal assembly 200 radially toward and away from the tubular 106.

The BOP 104 may allow the tubular 106 to pass through the BOP 104 during normal operation, such as run in, drilling, logging, and the like. In the event of an upset, a pressure surge, or other triggering event, the BOP 104 may sever the tubular 106 and/or seal the hole 202 in order to prevent fluids from being released from the wellbore 108. While the BOP 104 is depicted as having a specific configuration, it will be appreciated that the BOP 104 may have a variety of shapes, and be provided with other devices, such as sensors (not shown). An example of a BOP that may be used is described in U.S. Pat. No. 5,735,502, the entire contents of which are hereby incorporated by reference.

The blade assembly 102 may have the tubular centering system 118 and the blades 120 each secured to a ram block 208. Each of the ram blocks 208 may be configured to hold (and carry) the blade 120 and/or the tubular centering system 118 as the blade 120 is moved within the BOP 104. The ram blocks 208 may couple to actuators 210 via ram shafts 212 in order to move the blade assembly 102 within the channel 206. The actuator 210 may be configured to move the ram shaft 212 and the ram blocks 208 between an operating (or non-engagement) position, as shown in FIG. 2, and an actuated (or engagement) position wherein the ram blocks 208 have engaged and/or severed the tubular 106 and/or sealed the hole 202. The actuator 210 may be any suitable actuator, such as a hydraulic actuator, a pneumatic actuator, a servo, and the like. The seal assembly 200 may also be used to center the tubular 106 in addition to, or as an alternative to the tubular centering system 118.

Figure 3:
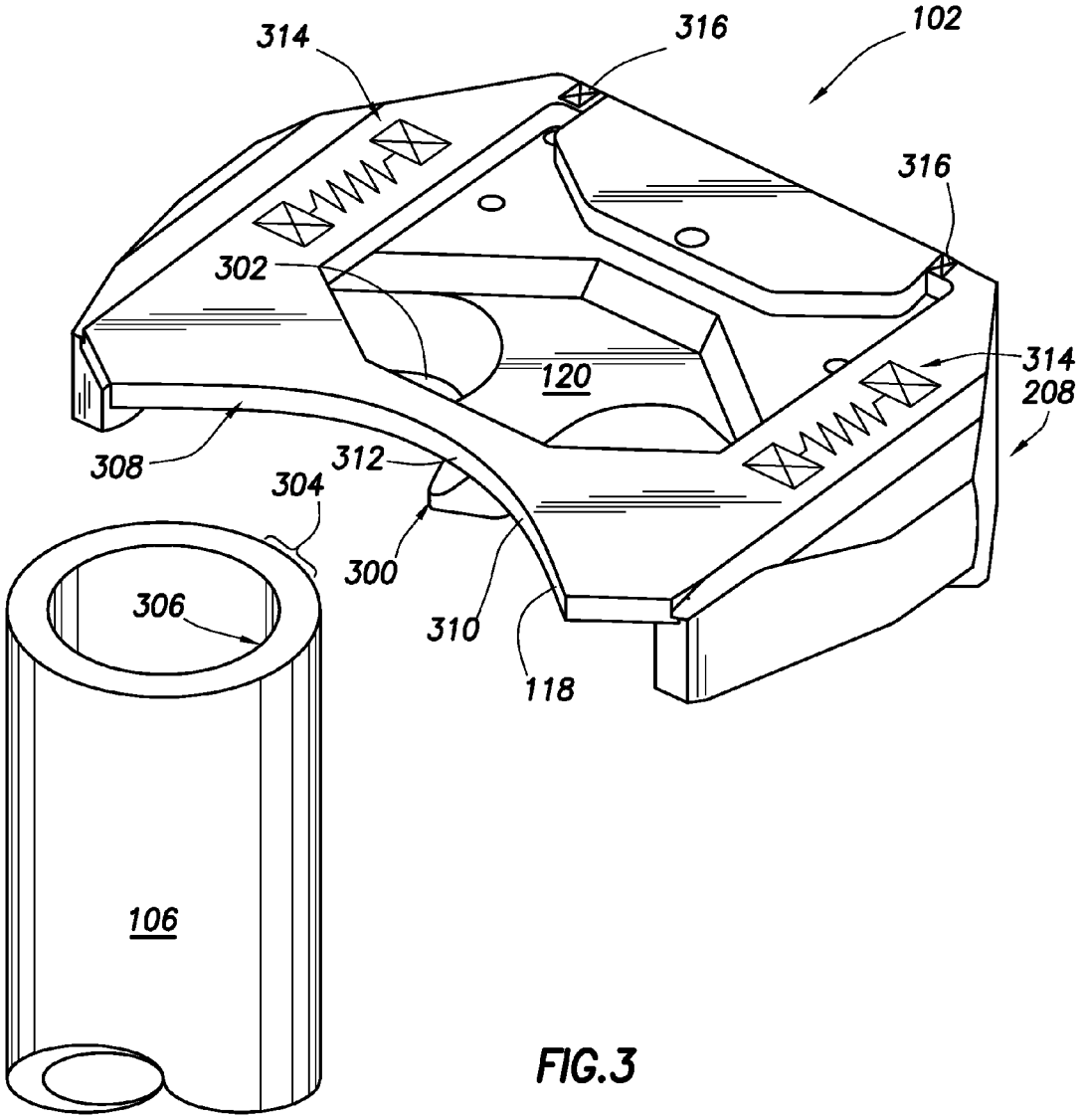
FIG. 3-6 are various schematic views of a portion of the blade assembly of FIG. 1 having a blade and a tubular centering system.

FIG. 3 is a schematic perspective view of a portion of the blade assembly 102 having the blade 120 and the tubular centering system 118. The blade 120 and tubular centering system 118 are supported by one of the ram blocks 208. It should be appreciated that there may be another ram block 208 holding another of the blades 120 and/or the tubular centering systems 118 working in cooperation therewith, as shown in FIG. 2. The blade 120, as shown, is configured to sever the tubular 106 using multi-phase shearing. The blade 120 may have a puncture point 300 and one or more troughs 302 along an engagement end of the blade. Further, any suitable blade for severing the tubular 106 may be used in the blade assembly 102, such as the blades disclosed in U.S. Pat. Nos. 7,367,396; 7,814,979; 2011/0000670; 2011/0226475; 2011/0226476; and/or 2011/0226477, the entire contents of which are hereby incorporated by reference.

The tubular centering system 118 may be configured to locate the tubular 106 at a central location in the BOP 104 (as shown, for example, in FIG. 2). The central location is a location wherein the puncture point 300 may be aligned with a central portion 304 of the tubular 106. In the central location, the puncture point 300 may pierce a tubular wall 306 of the tubular 106 proximate the central portion 304 of the tubular 106. In order for the puncture point 300 to pierce the tubular 106 as desired, it may be required to center the tubular 106 prior to, or concurrent with, engaging the tubular 106 with the blade 120.

The tubular centering system 118, as shown in FIG. 3, may have a retractable guide 308 configured to engage the tubular 106 prior to the blade 120. The guide 308 may have any suitable shape for engaging the tubular 106 and moving (or urging) the tubular 106 toward the central location as the ram block 208 moves toward the tubular 106. As shown, the guide 308 is a curved, concave or C-shaped, surface 310 having an apex 312 that substantially aligns with the puncture point 300 along a central portion of the surface 310 at an engagement end thereof. The curved surface 310 may engage the tubular 106 prior to the blade 120 as the ram block 208 moves the blade assembly 102 radially toward the tubular 106. The curved surface 310 may guide the tubular toward the apex 312 with the continued radial movement of the ram block 208 until the tubular 106 is located proximate the apex 312.

The tubular centering system 118 may have one or more biasing members 314 and/or one or more frangible members 316. The biasing members 314 and/or the frangible members 316 may be configured to allow the guide 308 to collapse and/or move relative to the blade 120 as the blade 120 continues to move toward and/or engage the tubular 106. Therefore, the guide 308 may engage and align the tubular 106 to the central location in the BOP 104 (as shown in FIGS. 1 and 2). The biasing members 314 and/or the frangible member(s) 316 may then allow the guide 308 to move as the blade 120 engages and severs the tubular 106. Either the biasing members 314 or the frangible members 316 may be used to allow the guide 308 to move relative to the blade 120. Further, both the biasing member 314 and the frangible member 316 may be used together as redundant systems to ensure the ram blocks 208 are not damaged. In the case where both the biasing members 314 and the frangible members 316 are used together, the biasing members 314 may require a guide force to move the guide 308, greater than the guide force required to break the frangible members 316.

The biasing members 314 may be any suitable device for allowing the guide 308 to center the tubular 106 and move relative to the blade 120 with continued radial movement of the ram block 208. A biasing force produced by the biasing members 314 may be large enough to maintain the guide 308 in a guiding position until the tubular 106 is centered at the apex 312. With continued movement of the ram block 208, the biasing force may be overcome. The biasing member 314 may then allow the guide 308 to move relative to the blade 120 as the blade 120 continues to move toward and/or through the tubular 106. When the ram block 208, if moved back toward the operation position (as shown in FIG. 2) and/or when the tubular 106 is severed, the biasing member 314 may move the guide 308 to the initial position, as shown in FIG. 3. The biasing members 314 may be any suitable device for biasing the guide 308, such as a leaf spring, a resilient material, a coiled spring and the like.

The frangible members 316 may be any suitable device for allowing the guide 308 to center the tubular 106 and then disengage from the blade 120. The frangible member(s) 316 may allow the guide 308 to center the tubular 106 in the BOP 104. Once the tubular 106 is centered, the continued movement of the ram block 208 toward the tubular 106 may increase the force on the frangible members 316 until a disconnect force is reached. When the disconnect force is reached, the frangible member(s) 316 may break, thereby allowing the guide 308 to move or remain stationary as the blade 120 engages and/or pierces the tubular 106. The frangible member(s) 316 may be any suitable device or system for allowing the guide to disengage the blades 120 when the disconnect force is reached, such as a shear pin, and the like.

Figure 4:
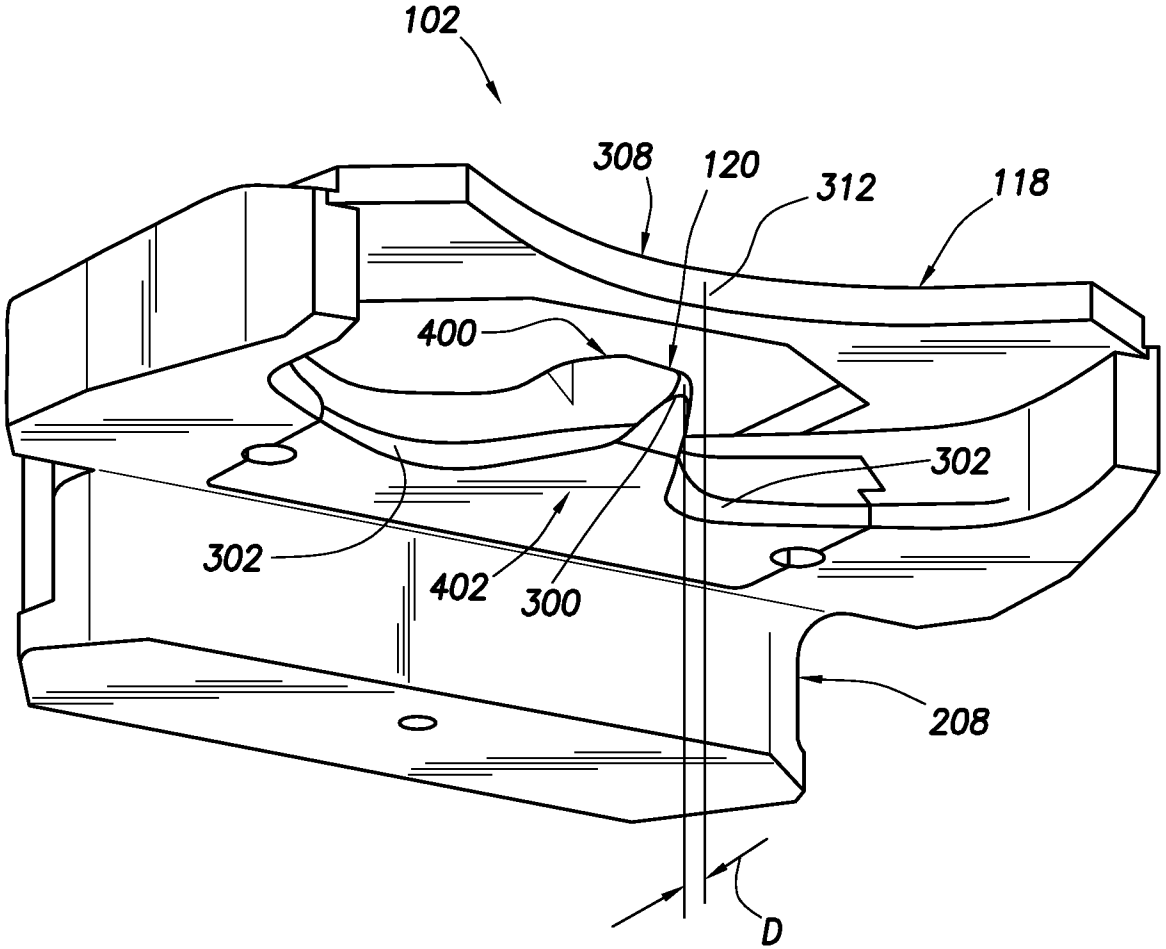

FIG. 4 is an alternate view of the portion of the blade assembly 102 of FIG. 3. The guide 308, as shown, has the apex 312 located a distance D in the radial direction from the puncture point 300. The tubular centering system 118 may be located on a top 400 of the blade 120 thereby allowing an opposing blade 120 (shown in FIG. 2) to pass proximate the blade 120 as the tubular 106 is severed. The opposing blade 120 may have the tubular centering system 118 located on a bottom 402 of the blade 120. The ram block 208 may be any suitable ram block configured to support the blade 120 and/or the tubular centering system 118.

Figure 5:
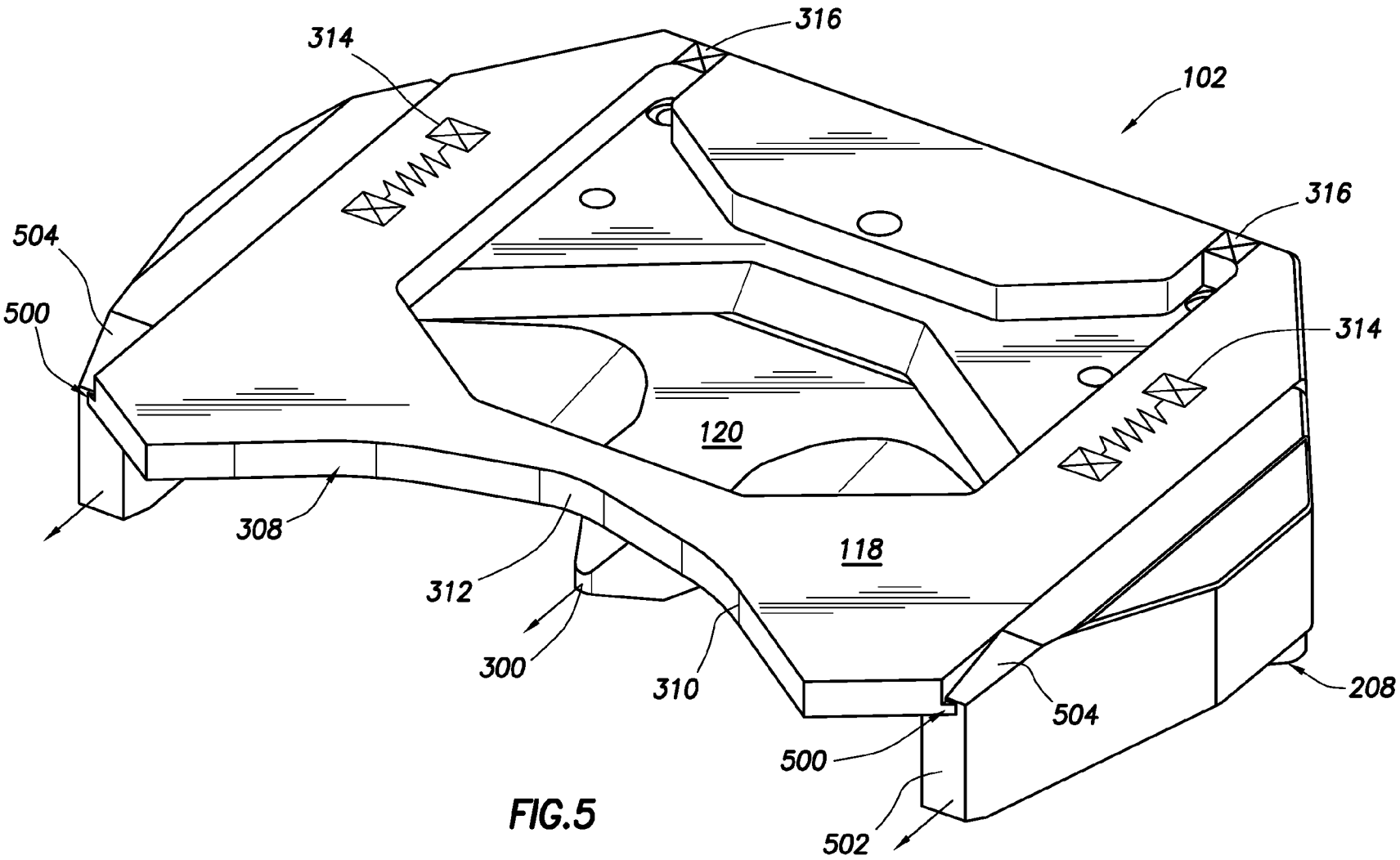

FIG. 5 is another view of the portion of the blade assembly 102 of FIG. 3. As shown, the tubular centering system 118 may have a release mechanism (or lip) 500 configured to maintain the guide 308 in a guide position, as shown. The lip 500 may be any suitable upset, or shoulder, for engaging a ram block surface 502. The lip 500 may maintain the guide 308 in the guide position until the force in the guide 308 becomes large, and a disconnect force is reached as a result of the tubular 106 reaching the apex 312. The continued movement of the ram block 208 may deform, and/or displace the lip 500 from the ram block surface 502. The lip 500 may then travel along a ramp 504 of the ram block 208 as the guide 308 displaces relative to the blade 120.

Figure 6:
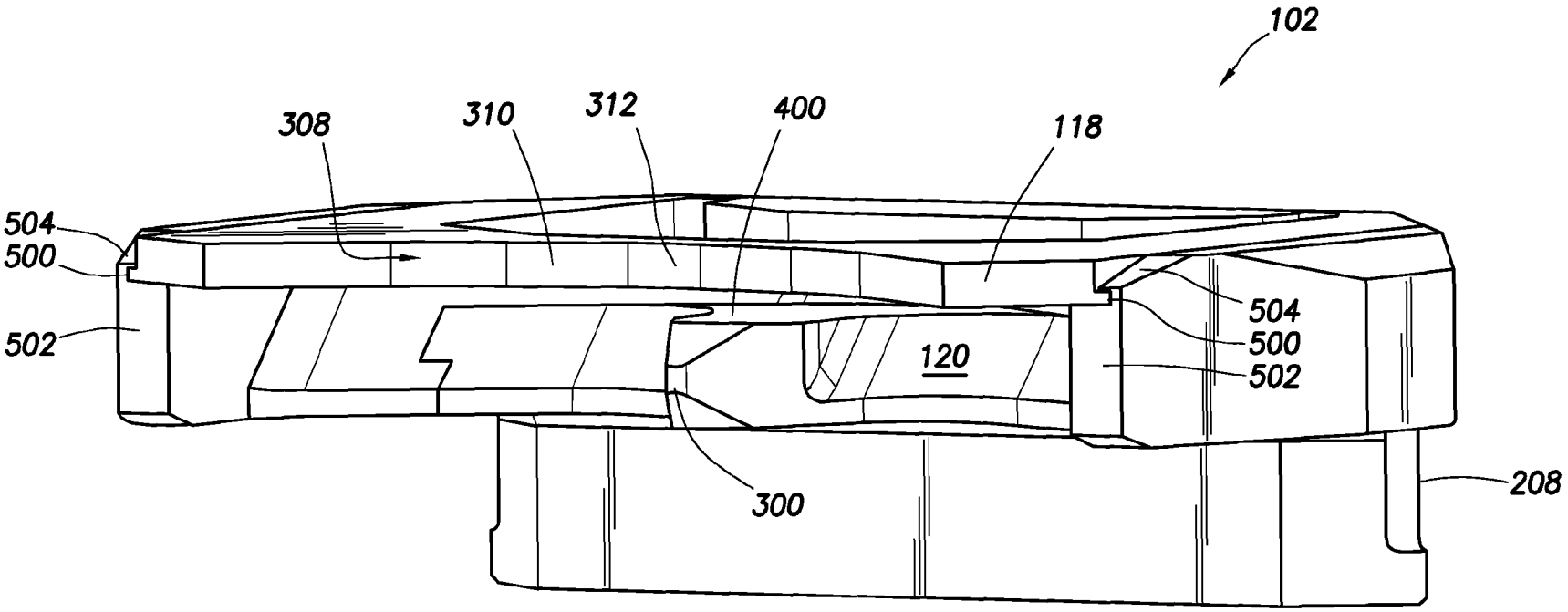

FIG. 6 is another view of the blade assembly 102 of FIG. 4. The tubular centering system 118 is shown in the guide position. In the guide position, the guide 308 has not moved and/or broken off and is located above the top 400 of the blade 120. The lip 500 may be engaged with the ram block surface 502 for extra support of the guide 308.

Figure 7:
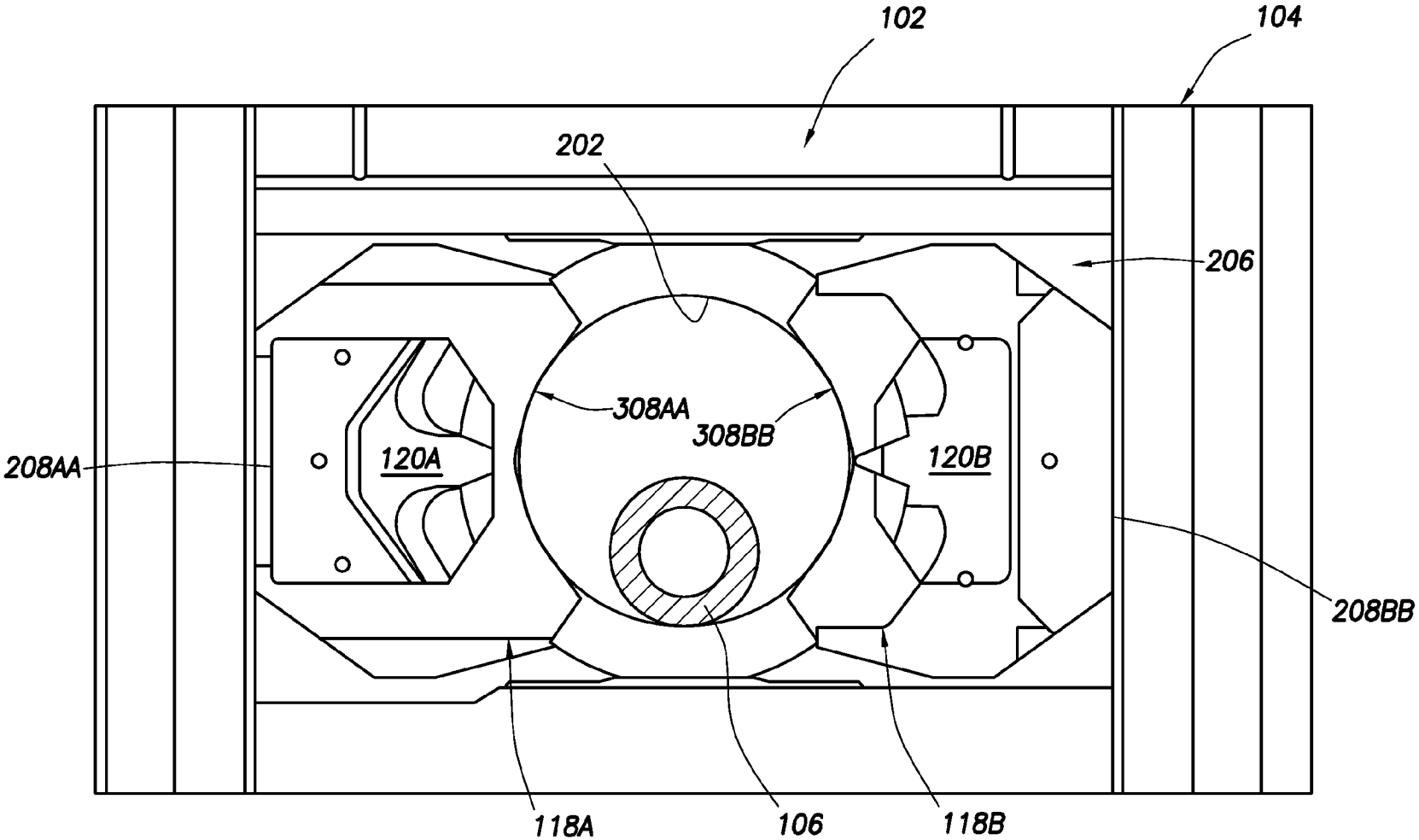
FIGS. 7-17 are schematic views of a portion of a cross-section of the BOP 104 of FIG. 2 taken along line 7-7 and depicting the blade assembly severing a tubular.

FIGS. 7-17 are schematic views of a portion of a cross-section of the BOP 104 of FIG. 2 taken along line 7-7 and depicting the blade assembly 102 severing (or shearing) the tubular 106. FIG. 7 shows the BOP 104 in an initial operating position. The blade assembly 102 includes a pair of opposing tubular severing systems 118A and 118B, blades 120A and 120B and ram blocks 208AA and 208BB for engaging tubular 106. As shown in each of the figures, the pair of opposing blade assemblies 102 (and their corresponding severing systems 118A,B and blades 120A,B) are depicted as being the same and symmetrical about the BOP, but may optionally have different configurations (such as those shown herein).

In the operating position, the tubular 106 is free to travel through the hole 202 of the BOP 104 and perform wellsite operations. The ram blocks 208AA and 208BB are retracted from the hole 202, and the guides 308AA and 308BB of the tubular centering systems 118A and 118B may be positioned radially closer to the tubular 106 than the blades 120A and 120B. The blade assembly 102 may remain in this position until actuation is desired, such as after an upset occurs. When the upset occurs, the blade assembly 102 may be actuated and the severing operation may commence.

The tubular severing systems 118A,B, blades 120A,B and ram blocks 208AA,BB may be the same as, for example, the tubular severing system 118, blade 120 and ram block 208 of FIGS. 3-6. The severing system 118B, blade 120B and ram block 208BB are inverted for opposing interaction with the severing system 118A, blade 120B and ram block 208BB (shown in an upright position). The blade 120A (or top blade), may be the blade 120 (as shown in FIG. 2) configured to face up, or travel over the blade 120B (or bottom blade) which may be the same blade 120 of FIG. 2 configured to face down.

Figure 8:
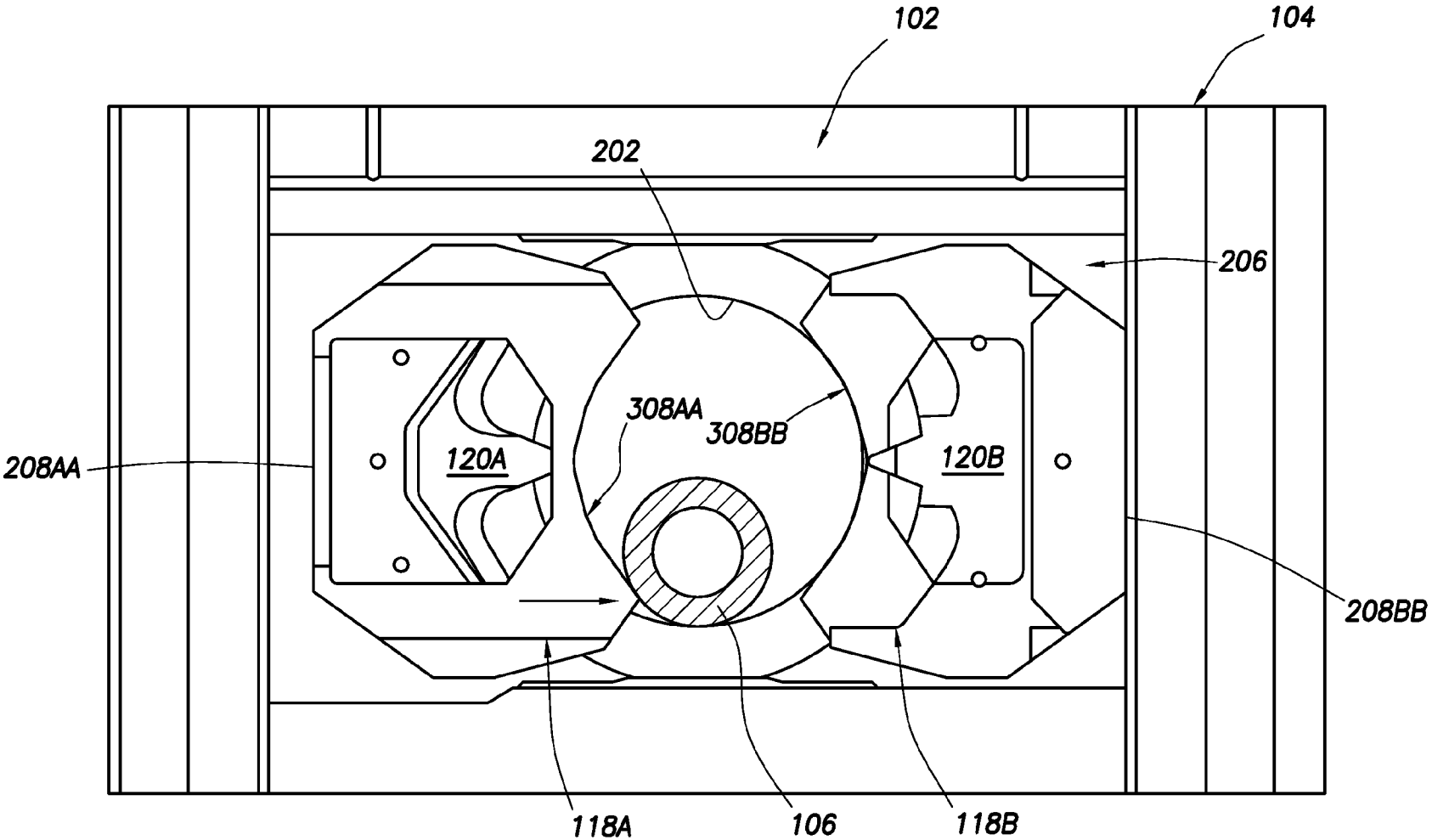

FIG. 8 shows the blade assembly 102 upon the commencement of the severing operation. As shown, the ram block 208AA may have moved the blade 120A and the tubular centering system 118A into the hole 202 and toward the tubular 106. Although FIGS. 7-17 show the upper blade 120A (and the ram block 208AA and pipe centering system 118A) moving first, the lower blade 120B may move first, or both blades 120A and 120B may move simultaneously. As the ram block 208AA moves, the guide 308AA engages the tubular 106.

Figure 9:
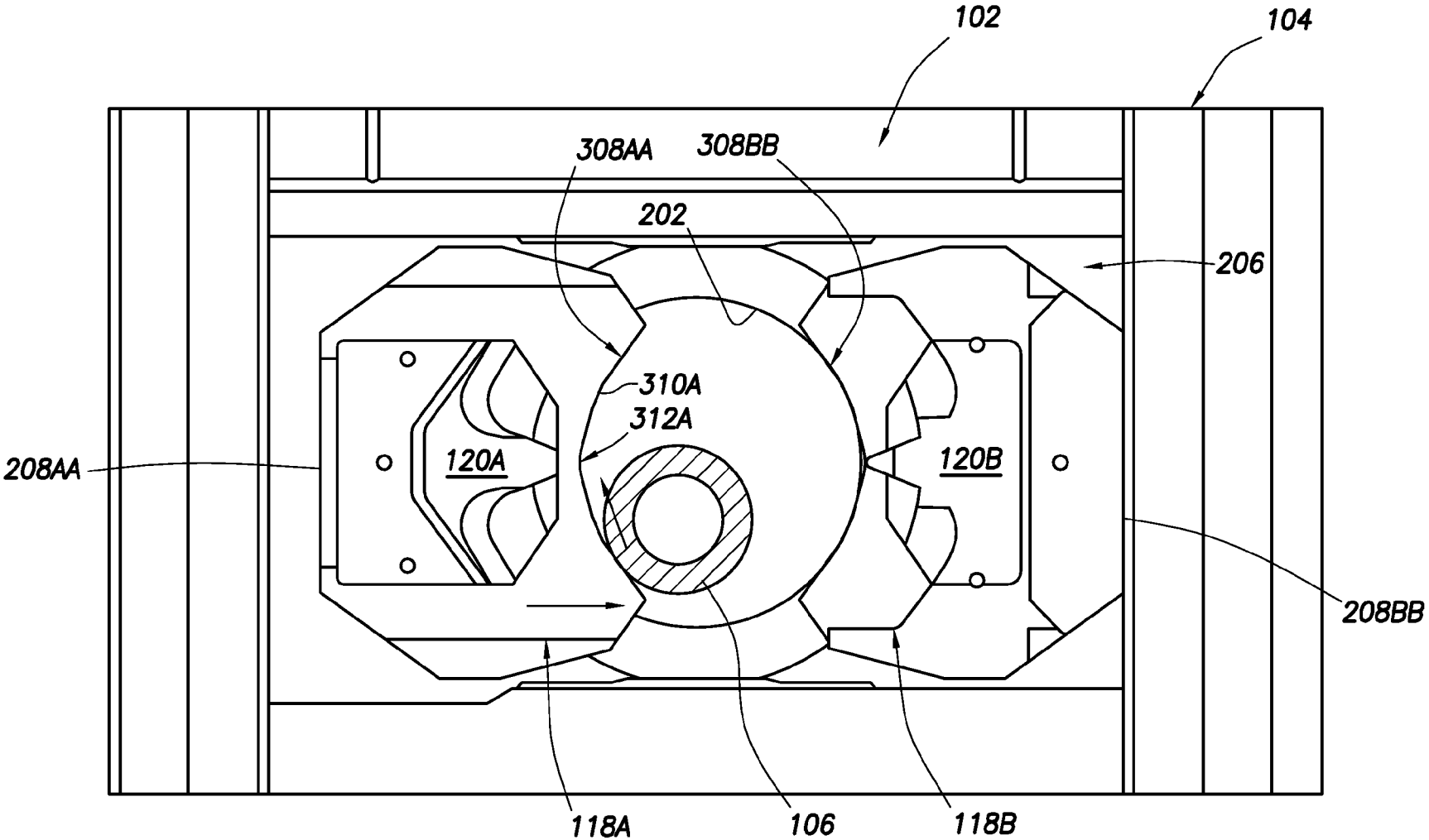
Figure 10:
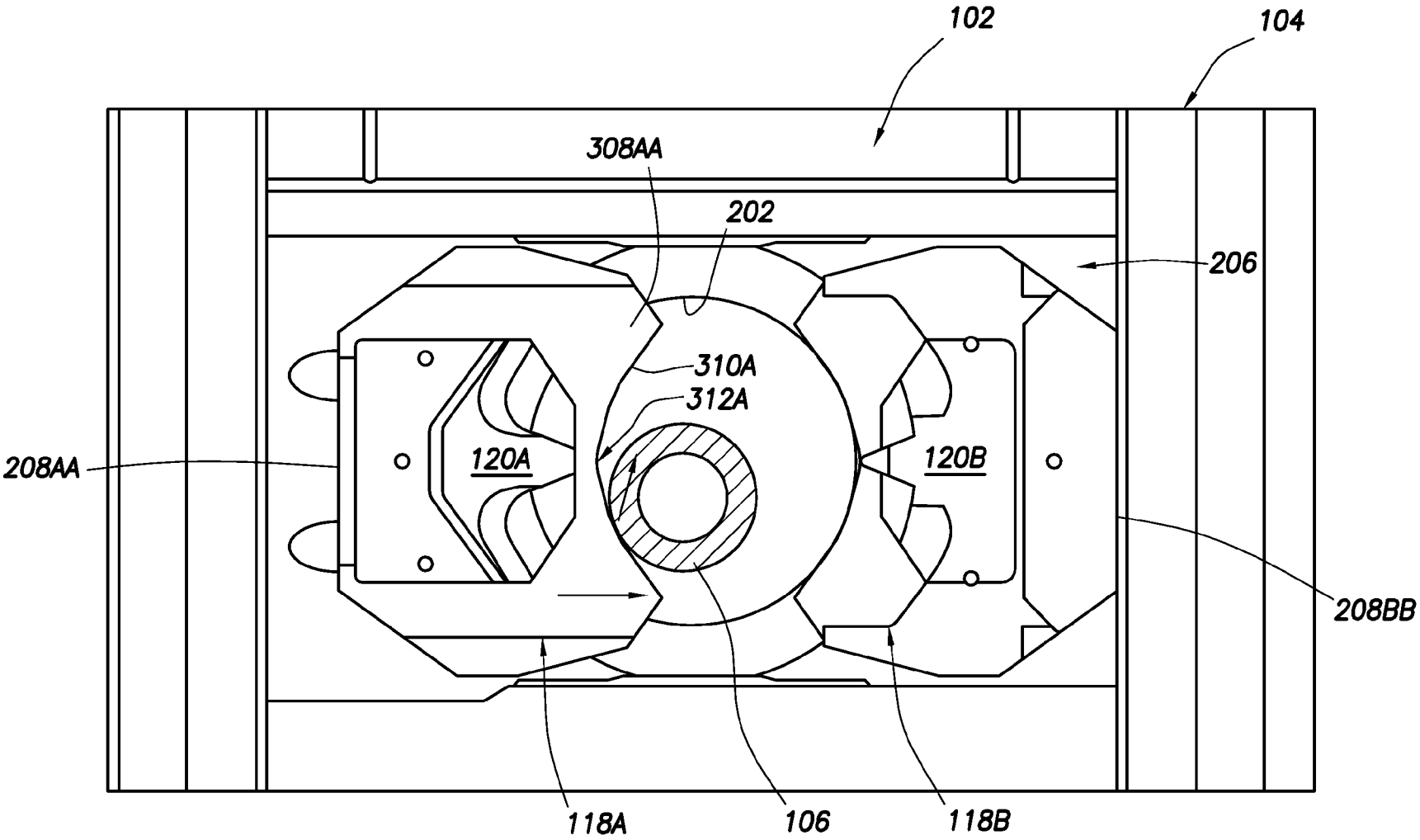

FIG. 9 shows the blade assembly 102 as the tubular 106 is initially being centered by the guide 308AA. As the ram block 208AA continues to move the blade 120A and the tubular centering system 118A radially toward the center of the BOP 104, the guide 308AA starts to center the tubular 106. The tubular 106 may ride along a curved surface 310A of the guide 308AA toward an apex 312A (in the same manner as the curved surface 310 and apex 312 of FIG. 3). As the tubular 106 rides along the curved surface 310A, the tubular 106 moves to a location closer to a center of the hole 202, as shown in FIG. 10.

Figure 11:
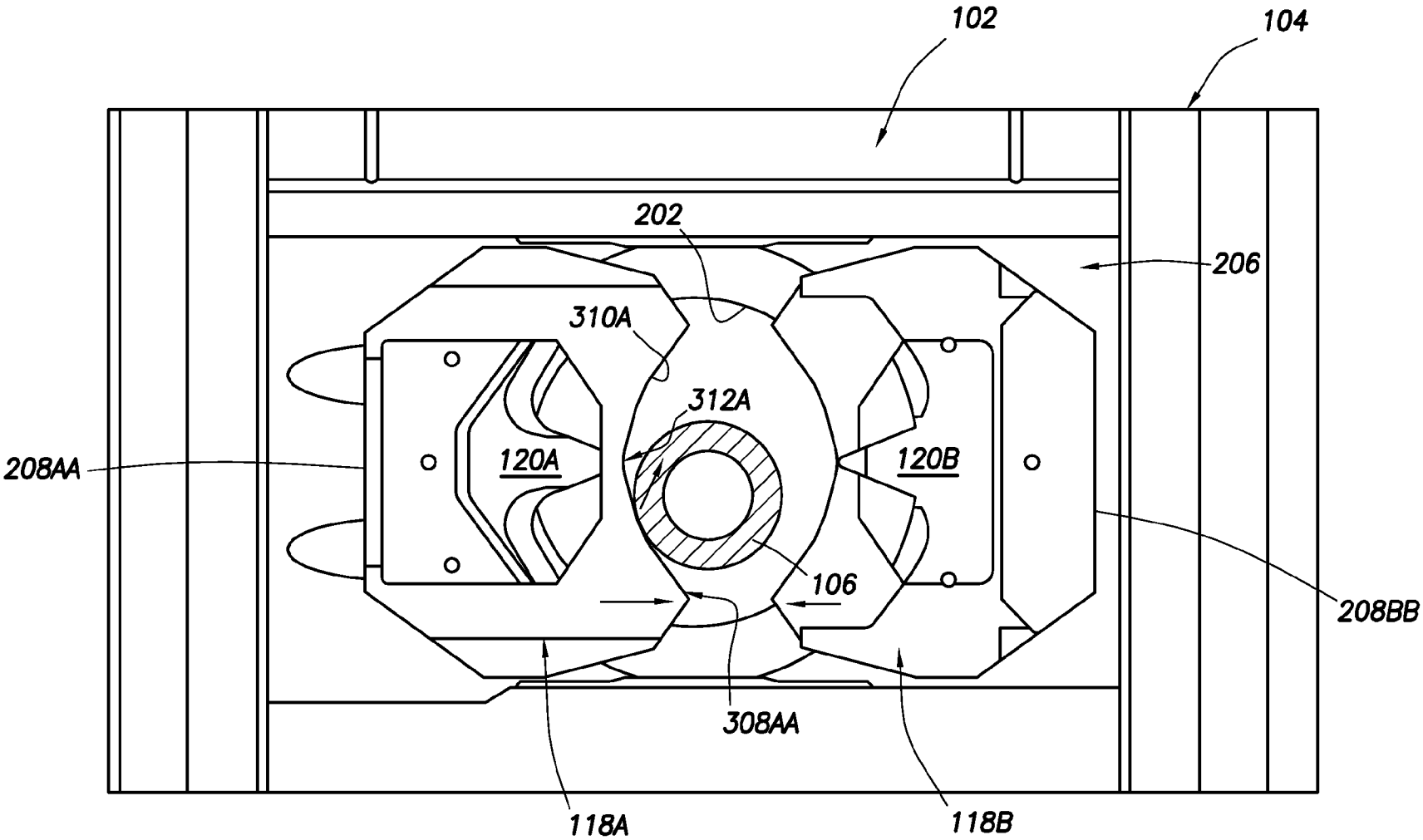

FIG. 11 shows the blade assembly 102 as the tubular 106 continues to ride along the guide 308AA toward the apex 312A of the curved surface 310A and the other blade 120B (or bottom blade) is actuated. The blade 120B may then travel radially toward center of the hole 202 in order to engage the tubular 106.

Figure 12:
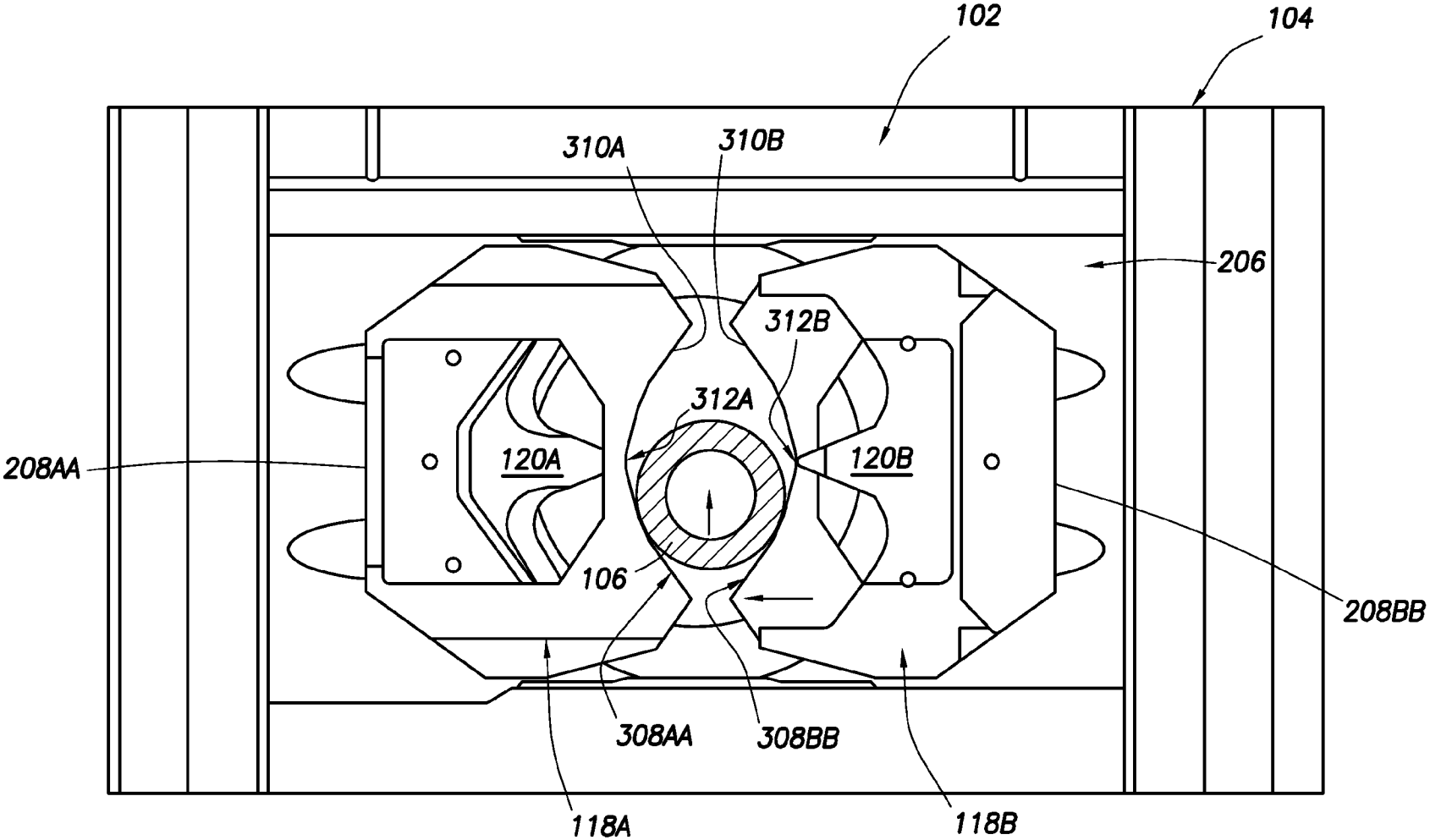

FIG. 12 shows the blade assembly 102 as both of the guides 308AA and 308BB engage the tubular 106 and continue to move the tubular 106 toward the apex 312A and 312B of the tubular centering systems 118A and 118B. The curved surface 310A and a curved surface 310B may wedge the tubular 106 between the tubular centering systems 118A and 118B as the ram blocks 208AA and 208BB continue to move the blades 120A and 120B toward the center of the BOP 104.

Figure 13:
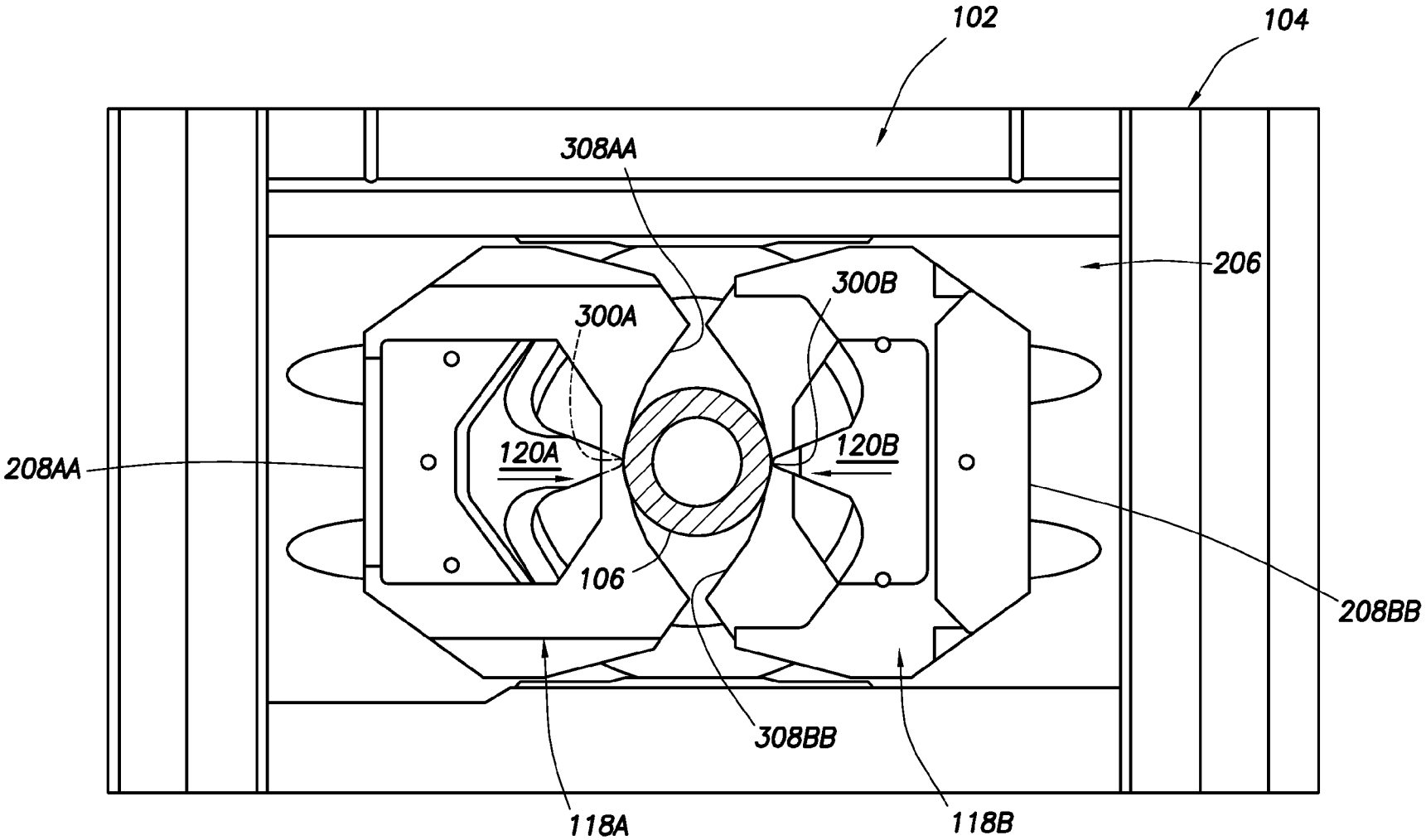

FIG. 13 shows the tubular 106 centered in the BOP 104 and aligned with puncture points 300A and 300B of the blades 120A and 120B. With the tubular 106 centered between the guides 308AA and 308BB, the continued radial movement of the ram blocks 208AA and 208BB will increase the force in the tubular centering systems 118A and 118B.

The force may increase in the tubular centering systems 118A and 118B until, the biasing force is overcome, and/or the disconnect force is reached. The guide(s) 308AA and/or 308BB may then move, or remain stationary relative to the blades 120A and 120B as the ram blocks 208AA and 208BB continue to move. The biasing force and/or the disconnect force for the tubular centering systems 118A and 118B may be the same, or one may be higher than the other, thereby allowing at least one of the blades 120A and/or 120B to engage the tubular 106.

Figure 14:
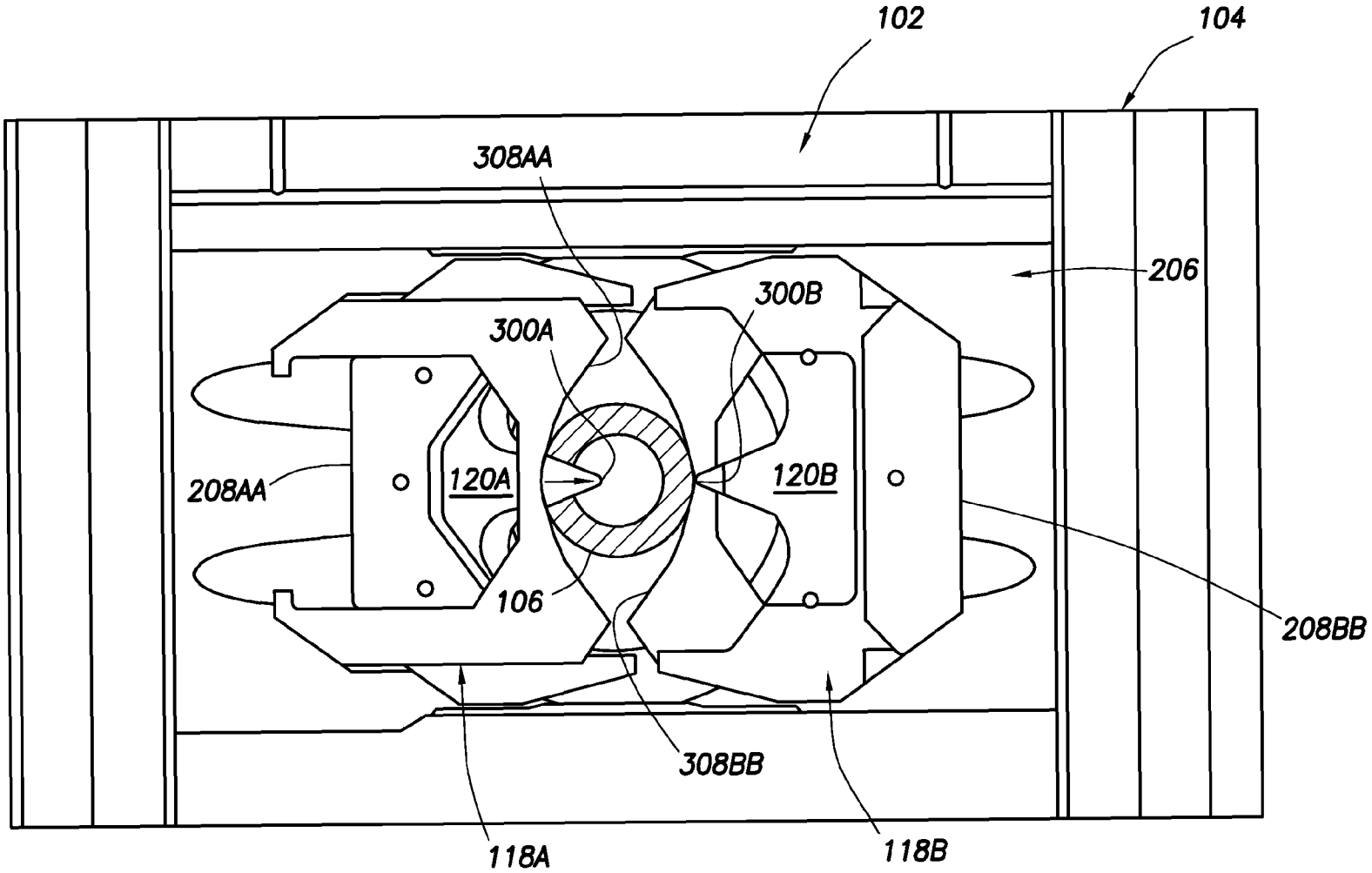

FIG. 14 shows the blade 120A puncturing the tubular 106. The blade 120A has moved relative to the guide 308AA, thereby allowing the puncture point 300A to extend past the guide 308AA and pierce the tubular 106. The tubular centering system 118B for the blade 120B (or the bottom blade) may still be engaged with the blade 120B thereby allowing the guide 308BB to hold the tubular 106 in place as the puncture point 300A pierces the tubular 106.

Figure 15:
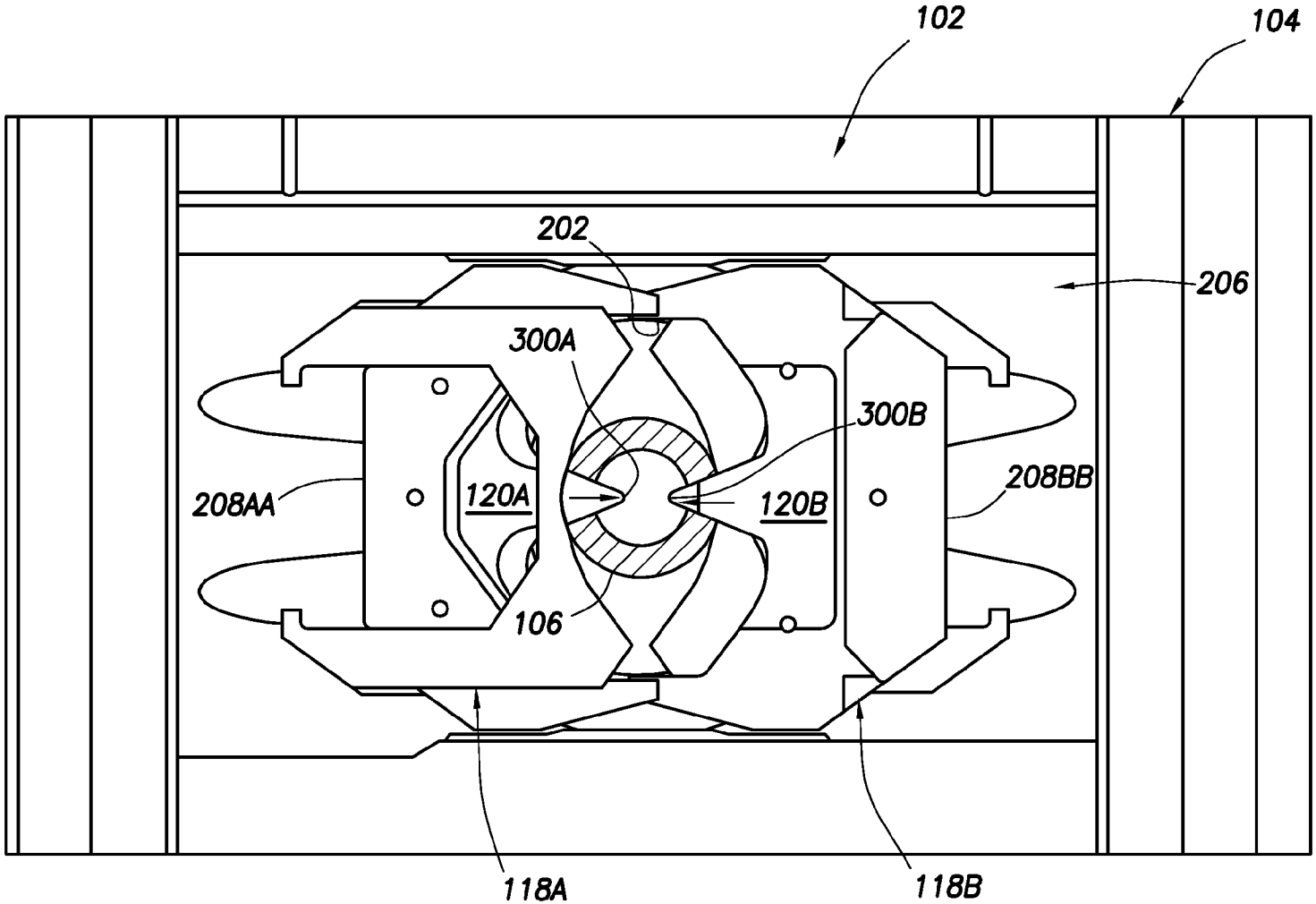

FIG. 15 shows both of the blades 120A and 120B puncturing the tubular 106. The tubular centering system 118B has been moved relative to the blade 120B (or bottom blade) thereby allowing the puncture point 300B to extend past the guide 308BB and puncture the tubular 106.

Figure 16:
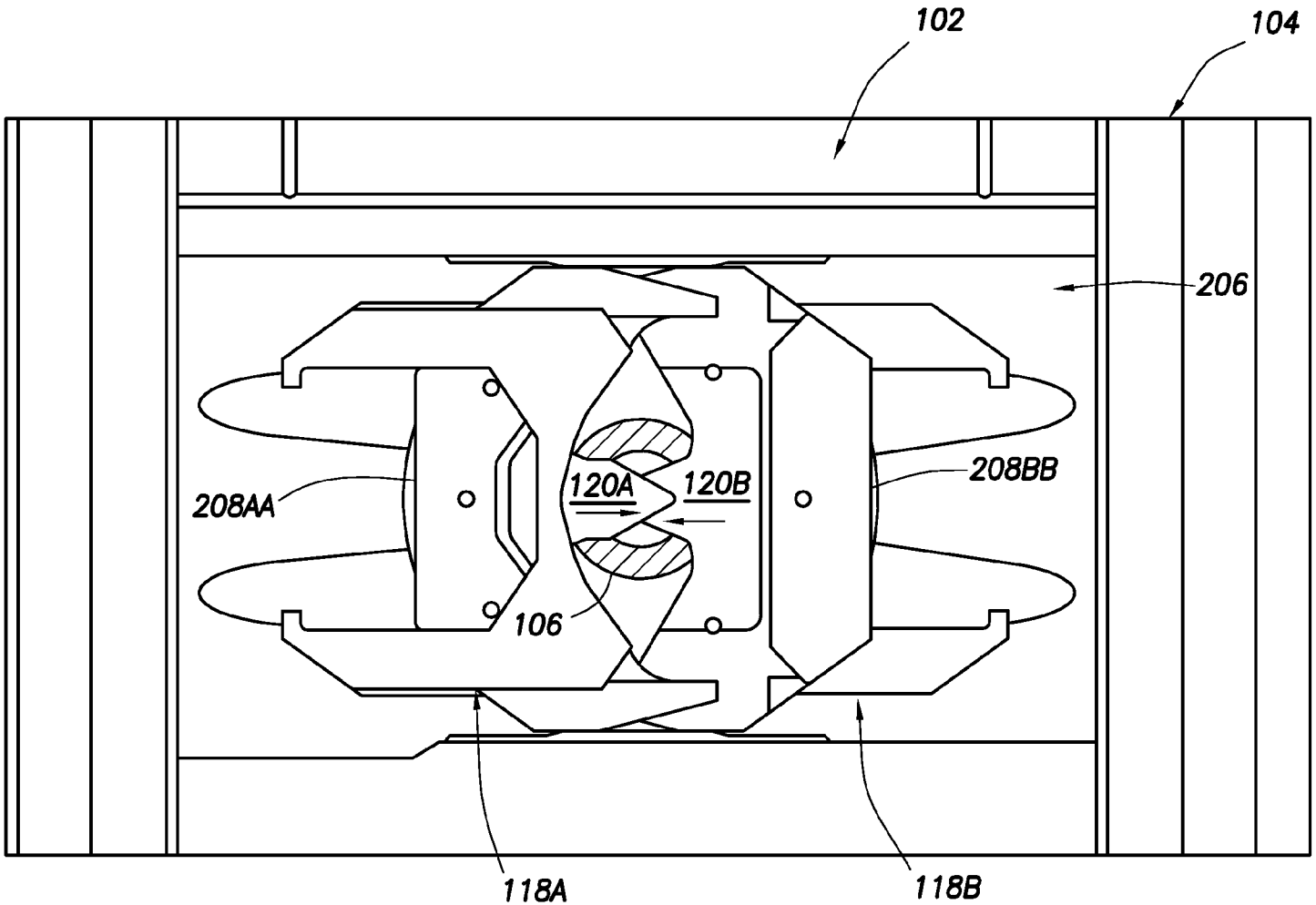
Figure 17:
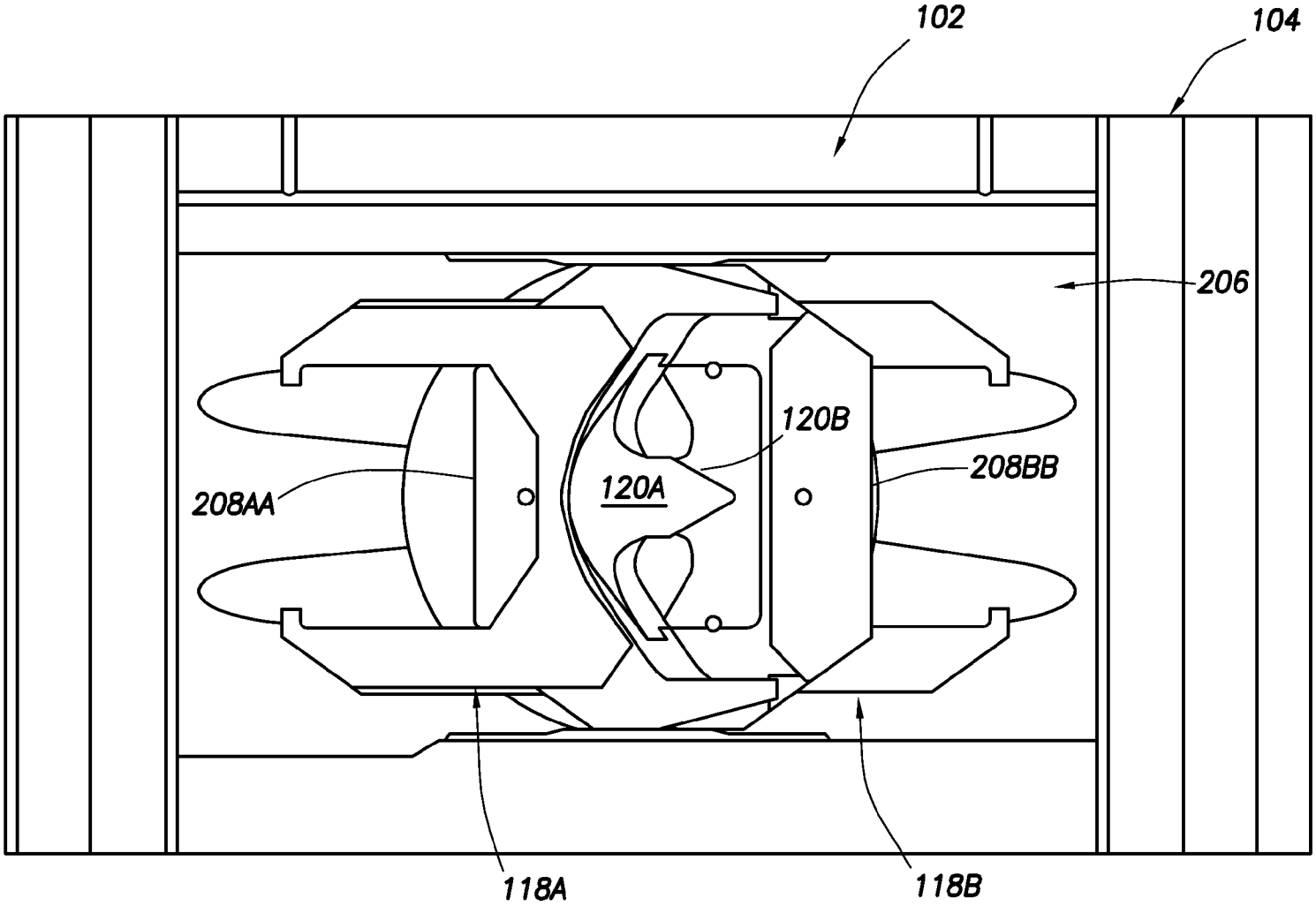

FIG. 16 shows the blades 120A and 120B continuing to shear the tubular 106 as the ram blocks 208AA and 208BB move radially toward one another in the channel 206. The top blade 120A is shown as passing over a portion of the bottom blade 120B. This movement is continued until the tubular 106 is severed as shown in FIG. 17.

FIGS. 18-27B show various versions of a blade assembly 102*a-j* and ram blocks 208*a-j* usable as the blade assemblies 102,102A,102B and ram blocks 208,208AA,208BB described herein. The blade assembly 102*a-j* may be similar to the previous blade assemblies herein, except that the blade assemblies 102*a-j* include a guide 308*a-j* and a release mechanism 1840-2740 as will be described herein. The release mechanism 1840-2740 may be used to release the guide 308*a-j* to move between a guide position engaging the tubular and a cutting position a distance behind an engagement end of the blade (similar to the movement described in FIGS. 12-17). The guides 308*a* may be positioned on opposite sides of the tubular 106 for engagement therewith (similar to the position shown in FIGS. 7-17). The guides 308*a-j* may be provided with a pocket 1831 for receiving a tip 1829 of an opposite guide 308.

Figure 18:
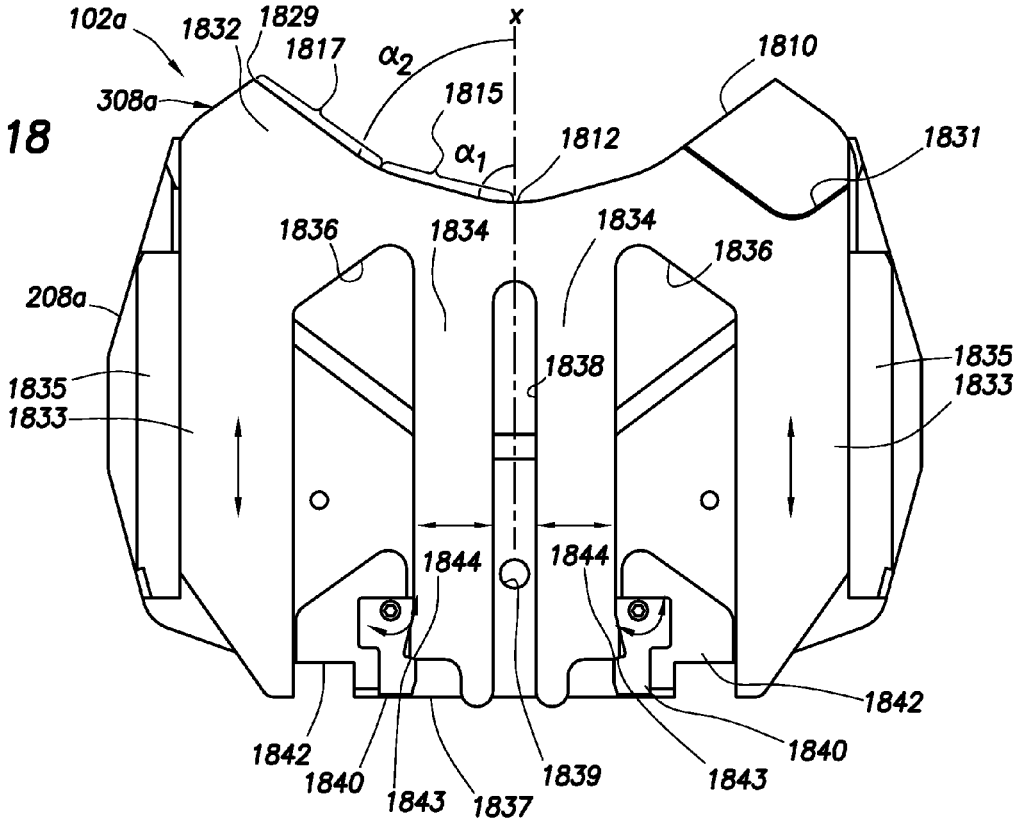
FIGS. 18-22 are schematic top views of various blade assemblies with latch release mechanisms.

FIG. 18 shows the blade assembly 102*a* including the guide 308*a* carried by the ram block 208*a*. The ram block 208*a* may have a rear end 1837 engageable by a ram (not shown) for moving the ram block 208*a* between an engagement and a non-engagement position about the tubular 106. The guide 308*a* has front portion 1832 with outer portions 1833 and inner springs 1834 extending therefrom. The outer portions 1833 are slidably receivable by the ram block 208*a* with the springs 1834 therebetween. The ram block 208*a* may be provided with raised outer shoulders 1835 for slidingly engaging the outer portions 1833.

Inner spring channels 1836 extend into the guide 308*a* between each outer portion 1833 and the springs 1834. A guide channel 1838 extends between the inner springs 1834 for allowing movement therebetween. The ram block 208*a* has raised shoulders 1842 slidingly receivable by the inner spring channels 1836 for guiding movement of the guide 308*a* along the ram block 208*a*. The inner spring channels 1836 and raised shoulders 1842 may be shaped for sliding engagement therebetween. The ram block 208*a* may also be provided with a guide pin 1839 slidingly receivable by the guide channel 1838 for guiding movement of the guide 308*a* along the ram block 208*a*.

The release mechanism 1840 is a latch 1840 pivotally mounted to the raised shoulder 1842 of the ram block 208*a*. The latches 1840 may be provided with springs (not shown) for urging the latches in a closed position against the inner springs 1834 for preventing movement of the guide 308*a*. The latches 1840 and the inner springs 1834 may have shoulders 1843,1844, respectively, for engagement therebetween.

Upon activation, the latches 1840 may be pivotally moved to an unlocked position away from the inner springs 1834 thereby permitting movement of the guide 308*a*. The guide 308*a* may be selectively retractable along the ram block 208*a* upon release by the latches 1840. Activation of the latches 1840 to release the springs 1834 may occur upon application of sufficient force (e.g., a disconnect force) to the guide 308*a*. Other manual, automatic, mechanical, electrical or other activations may be used to selectively release the latches 1840 when desired.

As also shown in FIG. 18, the guide 308*a* may have a concave guide surface 1810 for engaging the tubular. The concave guide surface 1810 may have an apex 1812 along a central axis X of the guide 308*a*. A first portion 1815 of the guide surface 1810 adjacent the apex 1812 may extend at a first angle $\alpha_1$ to the central axis X. A second portion 1817 of the guide surface 1810 may extend from the first portion at a second angel $\alpha_2$ to the central axis X.

Figure 19:
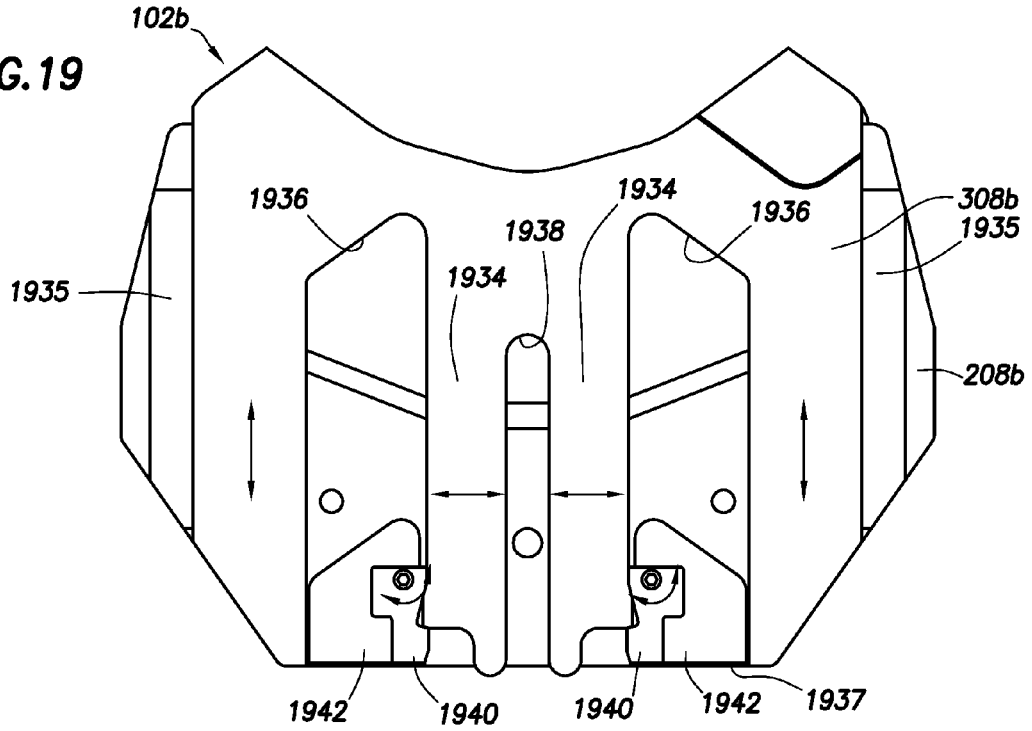

FIG. 19 shows another blade assembly 102*b* with a guide 308*b* slidably movable along ram block 208*b*. Blade assembly 102*b* is similar to blade assembly 102*a*, except that the guide channel 1938 between inner springs 1934 is shorter, the raised outer shoulders 1935 are reduced, and the shape of the ram block 208*b* is modified. The shortened guide channel 1938 and/or spring channel 1936 may be of a given length to define a travel distance of the guide 308*b* along ram block 208*b*. Rear end 1937 of the ram block 208*b* may be adjusted for receipt of a ram (not show). Shoulders 1942 and latches 1940 may be positioned to fit the shape of the rear end 1937. The rear end 1937 as shown in FIG. 19 is flat for receivable engagement of the ram.

Figure 20:
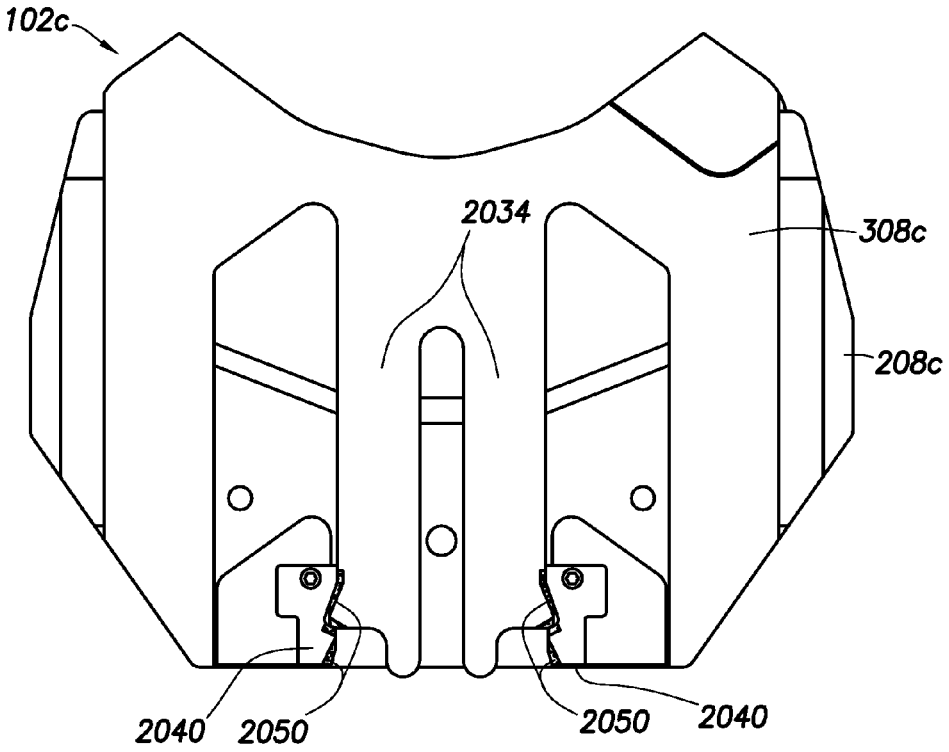

The blade assembly 102*c* and ram block 208*c* of FIG. 20 is the same as the blade assembly 102*b* of FIG. 19, except that portions thereof have been hardened for wear resistance. A coating 2050 has been applied along contact surfaces of the inner springs 2034 and the latches 2040. The coating 2050 may be any hardening material (e.g., titanium nitride or TN) applied thereto for facilitating interaction and resisting wear therebetween.

Figure 21:
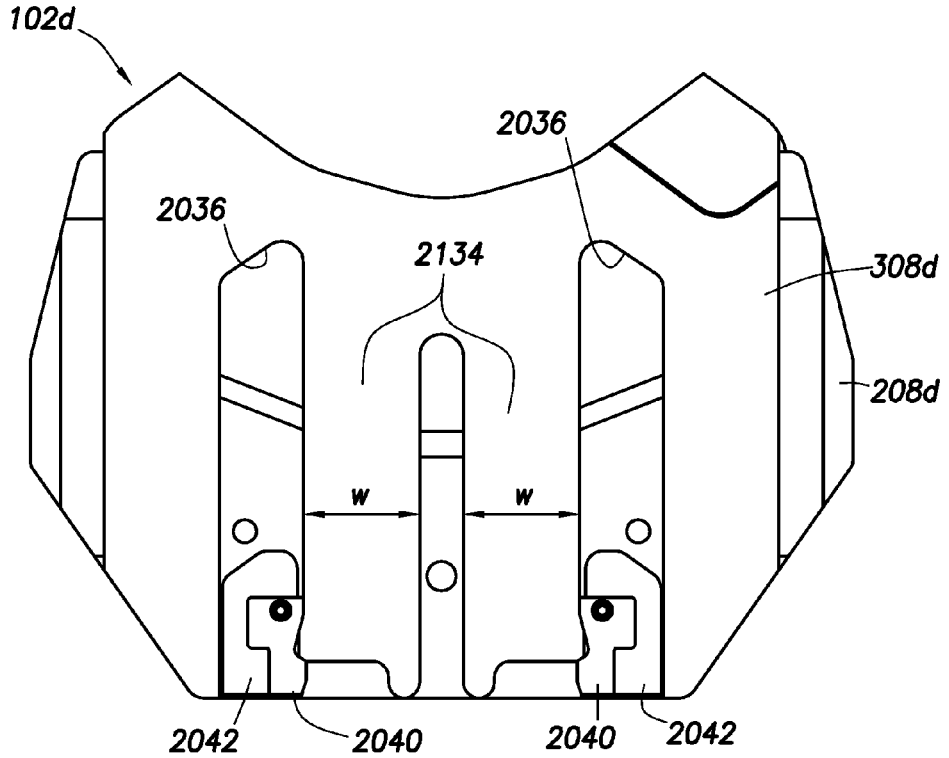

FIG. 21 shows a blade assembly 102*d* with a guide 308*d* carried by ram block 208*d*. The guide 308*d* is the same as the blade assembly 102*b* of FIG. 19, except that the width W of the inner springs 2134 has widened and the spring channels 2036, shoulders 2042, and latches 2040 have narrowed. The spring widths W may be selected for providing the desired flexibility for interaction with the latches 2040. The width W of the inner springs 2134 may be selected to provide the desired rigidity thereof, thereby defining the disconnect force required for activating the latches 2040 to release the guide 308*d*.

Figure 22:
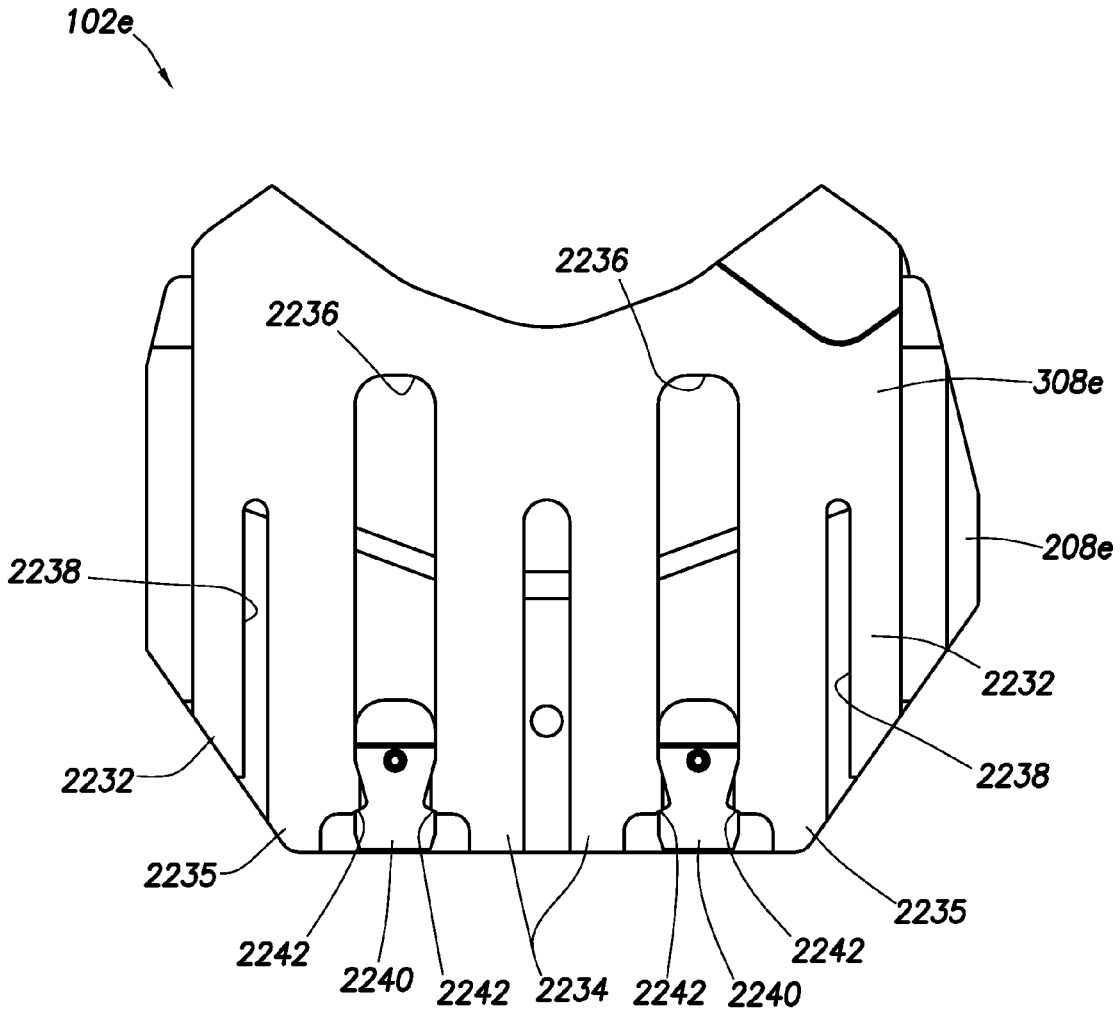

FIG. 22 shows a blade assembly 102*e* having a guide 308*e*. The blade assembly 102*e* is similar to blade assembly 102*d*, except that guide 308*e* has inner springs 2234 and outer springs 2235 with spring channels 2236 therebetween. Outer springs 2235 are positioned between each inner spring 2234 and the outer portions 2232 with an outer spring channel 2238 therebetween.

Double latches 2240 are positioned in the spring channel 2236 between the inner springs 2234 and the outer springs 2235. The double latches 2240 have notches 2242 on either side thereof for engaging the inner spring 2234 on one side, and the outer spring 2235 on an opposite side thereof. The inner springs 2234 and outer springs 2235 may release from the latches 2240 upon application of a disconnect force to the guide 308*e*.

Upon release, the double latches 2240 slidingly engage the inner and outer springs 2234, 2235 for providing sliding movement of the guide 308*e* along the ram block 208*e*. As also shown in FIG. 22, the spring channels 2238 have a modified shaped to conform to the modified shape of the double latches 2240.

FIGS. 23-27B show various blade assemblies 102*f-j* having guides 308*f-j* with release mechanisms 2340-2740. The blade assemblies 102*f-j* and guides 308*f-j* may be similar to the blade assemblies and guides previously described, except that the blade assemblies 102*f-j* are provided with various triggers 2360-2760 for activating various release mechanisms 2340-2740 as will be described herein.

Figure 23:
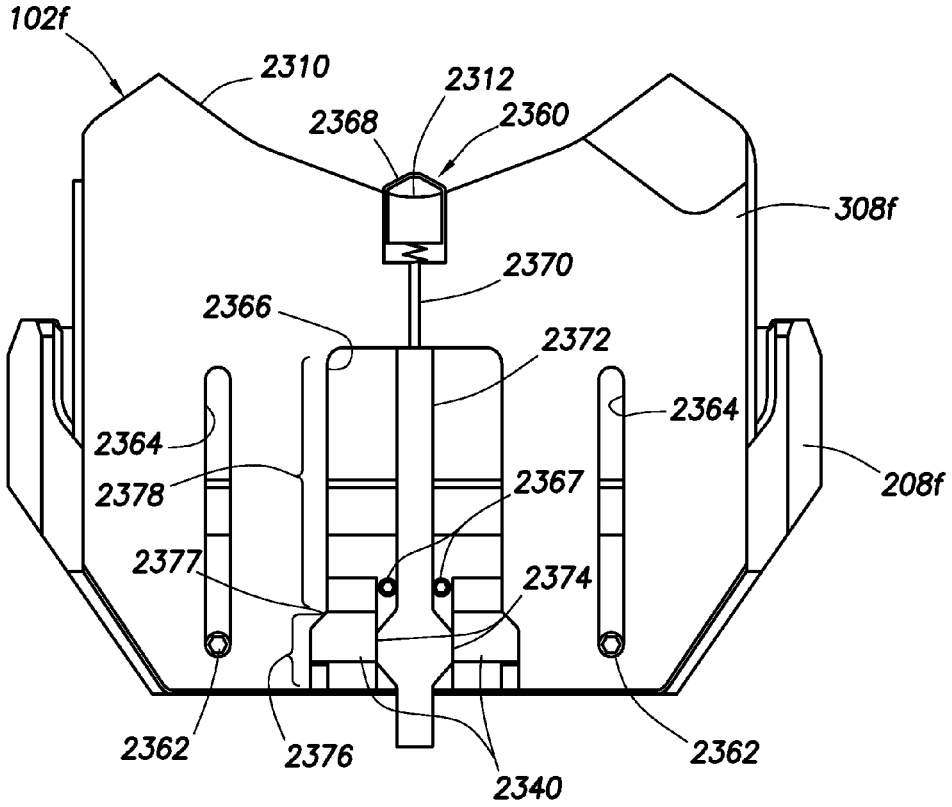
FIGS. 23-24 are schematic top views of various blade assemblies with trigger activated release mechanisms.

As shown in FIG. 23, the blade assembly 102*f* has a guide 308*f* slidably positionable about ram block 208*f* and a trigger 2360 along a guide surface 2310. Guide pins 2362 in the ram block 208*f* are receivable by travel slots 2364 for guiding the travel of the guide 308*f* along ram block 208*f*. The guide 308*f* is also provided with a trigger channel 2366 for receiving the release mechanism 2340.

The trigger 2360 includes a spring-loaded plunger 2368 extending a distance beyond apex 2312 of the guide surface 2310 of the guide 308*f*. The plunger 2368 is linked by a rod 2370 to a member 2372. The member 2372 is slidably positionable in the trigger channel 2366 between a guide position and a cutting position in response to force applied to the plunger 2368. Guide pins 2367 are positioned in the ram block 208*f* for slidably receiving the member 2372.

The release mechanism, including a pair of wedges, 2340 positioned in the trigger channel 2366 on either side of the member 2372. The member 2372 has raised shoulders 2374 on either side thereof for engagement with the wedges 2340. With the wedges 2340 positioned on raised shoulders 2374, the wedges 2340 are moved into a locked position in trigger channel 2366. The trigger channel 2366 has a wide portion 2376 for allowing the wedges 2340 to extend outwardly to lock along a shoulder 2377 in the trigger channel 2366. With the wedges 2340 positioned along the member 2372 off of raised shoulders 2374, the wedges 2340 are moved to an unlocked position in the trigger channel 2366. In the unlocked position, the wedges 2340 move to a narrow portion 2378 of the trigger channel 2366.

The trigger 2360 is activatable upon application of force along plunger 2368. Such force may be applied as a tubular presses against the plunger 2368. Once activated, the force applied to the plunger is translated via rod 2370 to member 2372. Member 2372 is translated such that wedges 2340 move from a locked position on shoulders 2374 of member 2372 to an unlocked position off of shoulders 2374 of member 2372, and from the wide portion 2376 to the narrow portion 2378 of the trigger channel 2366. In the unlocked position, the guide 308*f* is free to slidably move relative to the ram block 208*f* between the guide position and the cutting position.

Figure 24:
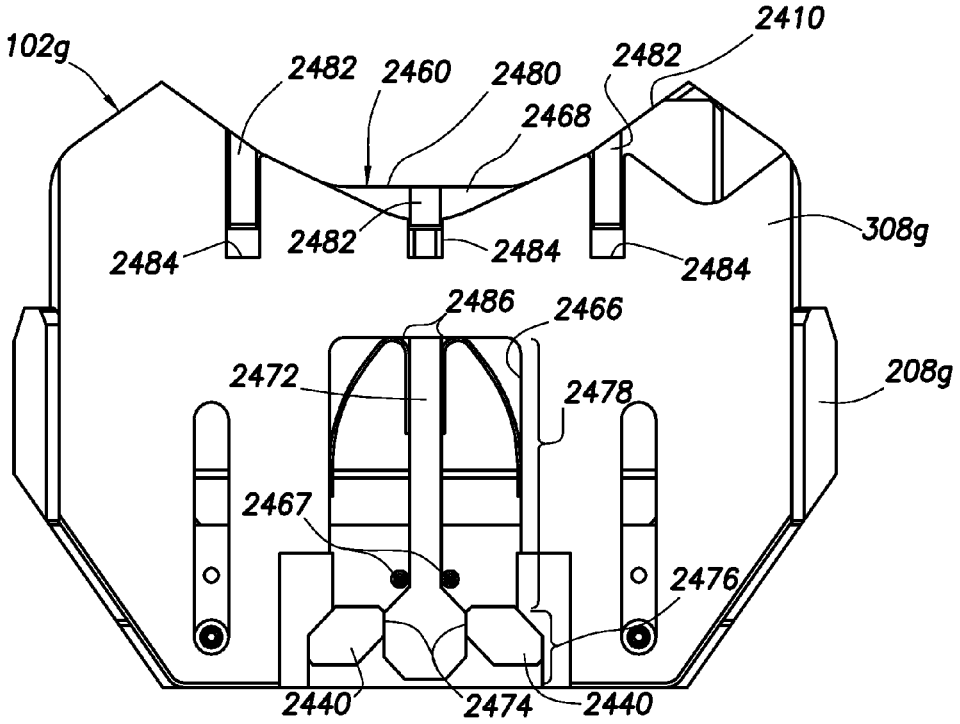

As shown in FIG. 24, the blade assembly 102*g* has a guide 308*g* slidably positionable about ram block 208*g*. The blade assembly 102*g* is similar to blade assembly 102*f*, except with a trigger 2460 along the guide surface 2410 and a member 2472 slidably positionable in a trigger channel 2466. The trigger 2460 includes a plunger 2468 with a trigger surface 2480 along the guide surface 2410, and trigger guides 2482 extending into trigger slots 2484 in the guide 308*g*. The trigger surface 2480 provides an extended contact surface for activation by a tubular and/or an opposing ram block and/or guide along guide surface 2410.

The member 2472 extends from the plunger 2468 and into the trigger channel 2466. The member 2472 is supported in trigger channel 2466 by biasing members 2486. The biasing members may apply a predefined resistance to movement of the member 2472. The member 2472 is slidably positionable in the trigger channel 2466 for engaging release mechanism (or wedges) 2440. The trigger channel 2466 has a wide portion 2476 for moving the wedges 2440 to a locked position when positioned along shoulders 2474 along member 2472. The trigger channel 2466 also has a narrow portion 2478 for moving the wedges 2440 to an unlocked position when positioned off of shoulders 2474 along member 2472. Guide pins 2467 are positioned in the ram block 208*g* for slidably receiving the member 2472.

Figure 25A:
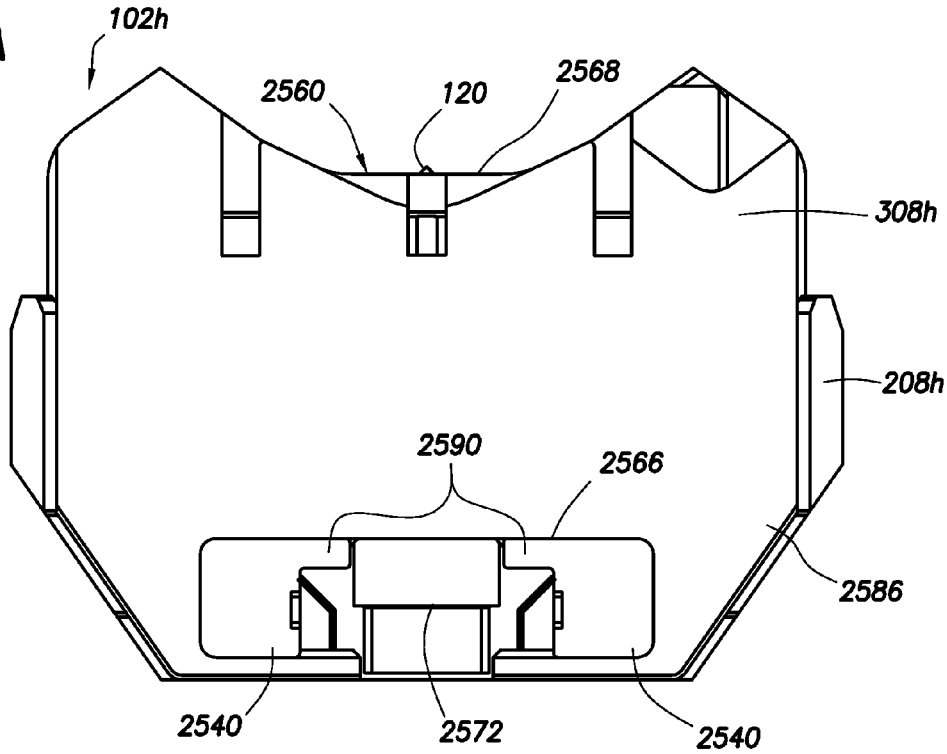
FIGS. 25A-25B are schematic top views of a blade assembly with a trigger activated wedge release mechanism.
Figure 25B:
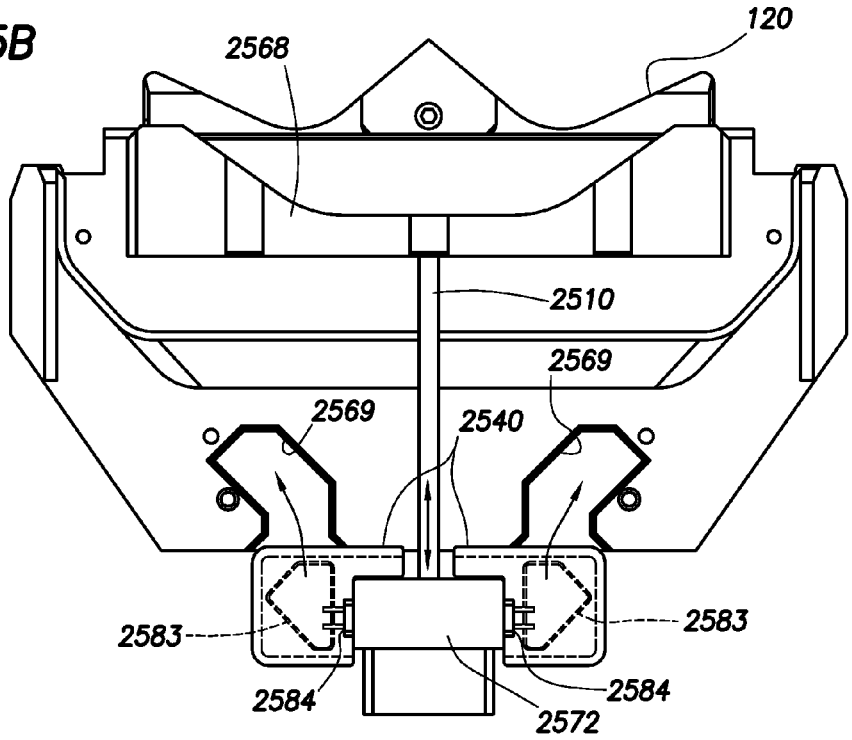

FIGS. 25A and 25B show schematic top views of blade assembly 102*h* including a guide 308*h* slidably positionable on ram block 208*h*, and a blade 120. FIG. 25A shows the guide 308*h* with a guide plate 2586 thereon. FIG. 25B shows the guide 308*h* with the guide plate 2586 removed to reveal the blade 120 and inner components of the guide 308*h*. The blade assembly 102*h* is similar to the blade assembly 102*g* of FIG. 24, except that the trigger 2560 has a plunger 2568 coupled to a member 2572 by rod 2510. The member 2572 is slidably movable in a trigger channel 2566 for activating a release mechanism (or wedges) 2540.

The wedges 2540 are coupled to the member 2572 by magnets 2584. The wedges 2540 are selectively extendable upon activation of the plunger 2568 by application of sufficient force thereto. Once activated, the member 2572 is retracted and the wedges 2540 move from a locked position as shown in FIG. 25A to an unlocked position as shown in FIG. 25B. In the locked position of FIG. 25A, the wedges 2540 have fingers 2590 extending therefrom for engaging the member 2572. In this position, the member 2572 is locked and prevented from moving until the plunger 2568 is activated. In the unlocked position of FIG. 25B, the fingers 2590 of wedges 2540 move to a position above member 2572. The wedges 2540 have bosses 2583 slidably positionable in passages 2569 in ram block 208*h* and the member 2572 is free to retract. In this unlocked position, the guide 308*h* may retract to a cutting position such that the blade 120 extends beyond the plunger 2568 for cutting a tubular.

Figure 26A:
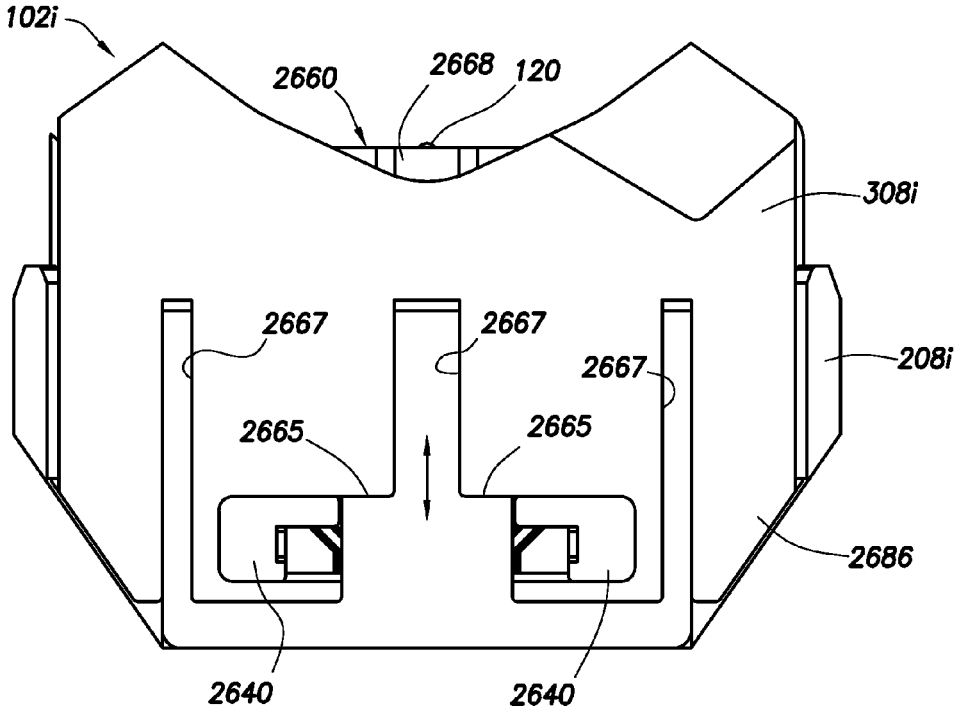
FIGS. 26A-26B are schematic top views of a blade assembly with a trigger activated, multi-contact wedge release mechanism.
Figure 26B:
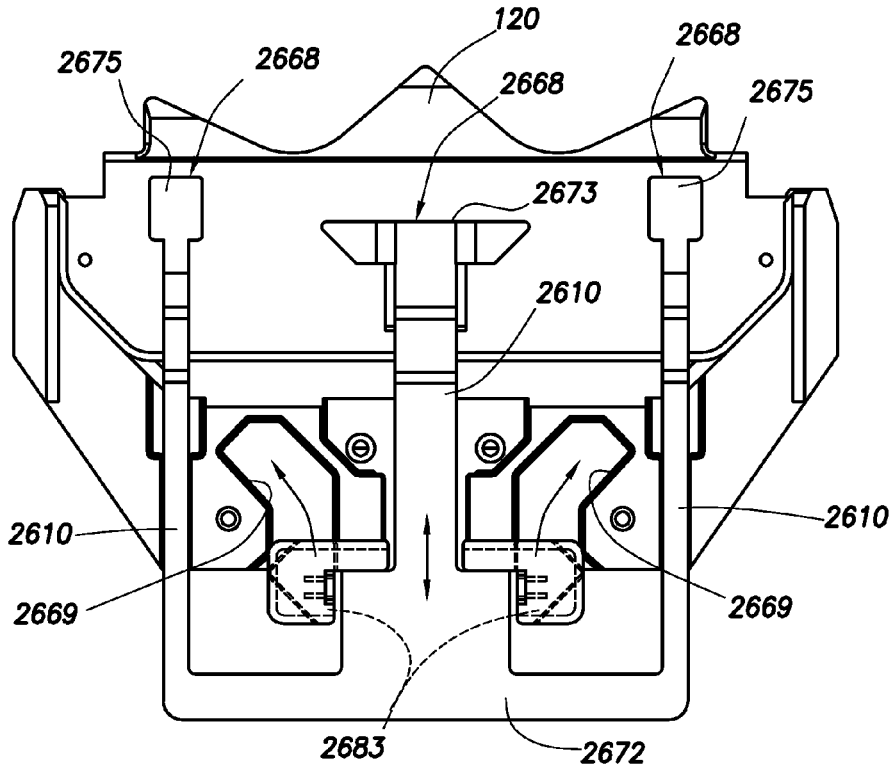

FIGS. 26A and 26B show schematic top views of blade assembly 102*i* including a guide 308*i* slidably positionable on ram block 208*i*, and a blade 120. FIG. 26A shows the guide 308*i* with a guide plate 2686 thereon. FIG. 26B shows the guide 308*i* with the guide plate 2686 removed to reveal the blade 120 and inner components of the guide 308*i*. The blade assembly 102*i* is similar to the blade assembly 102*g* of FIGS. 25A and 25B, except that the trigger 2660 has a plunger 2668 with three contacts 2673, 2675 coupled to a member 2672 by rods 2610. The member 2672 is slidably movable in trigger channels 2667 for activating a release mechanism (or wedges) 2640.

The central contact 2673 has lateral contacts 2675 on either side thereof to provide multiple points of contact for application of a disconnect force. The rods 2610 link the contacts 2673, 2675 to the member 2672 for providing a stabilized structure for smooth slidable movement in trigger channels 2667 of ram block 208*i*. The member 2672 also has steps 2665 that provide a positive stop in trigger channel 2667 against the guide 208*i*. The wedges 2640 have bosses 2683 that travel in passageway 2669 in the same manner as the wedges 2540 and bosses 2583 of FIGS. 25A and 25B.

Figure 27A:
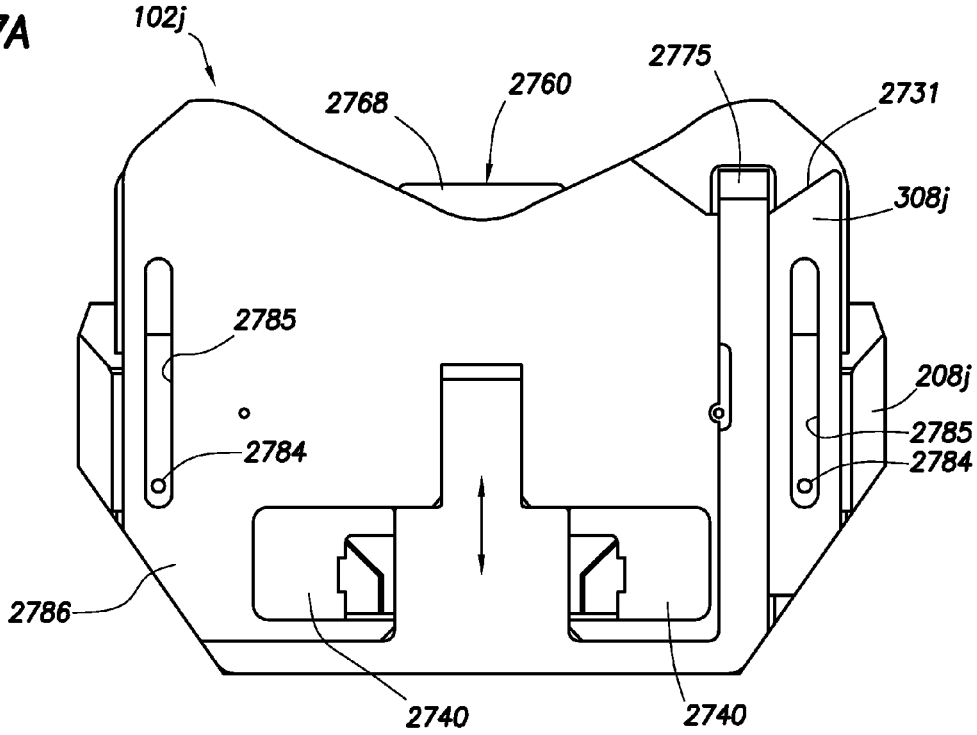
FIGS. 27A-27B are schematic top views of a blade assembly with a trigger activated multi-contact wedge release mechanism.
Figure 27B:
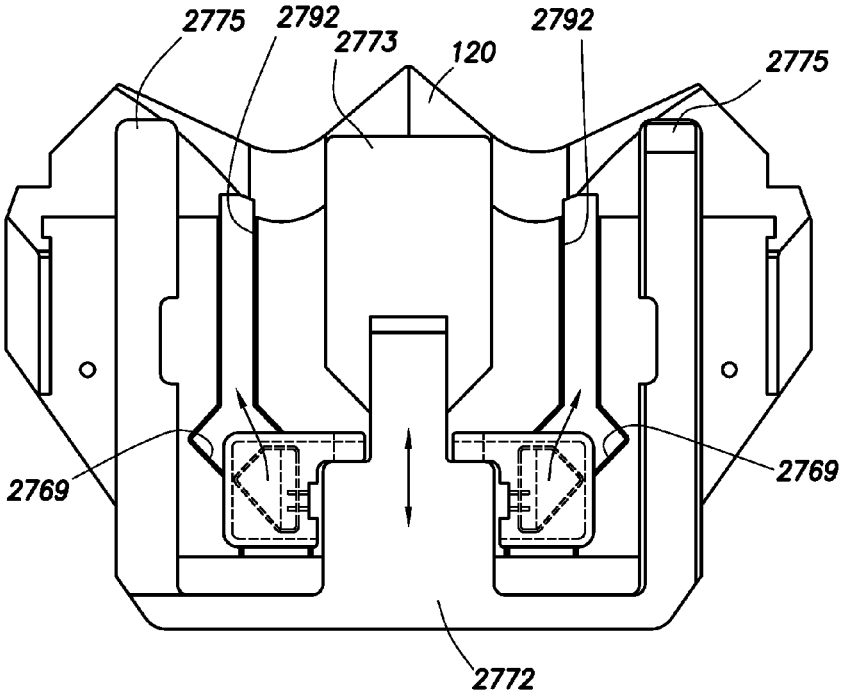

FIGS. 27A and 27B show schematic top views of blade assembly 102*j* including a guide 308*j* slidably positionable on ram block 208*j*, and a blade 120. FIG. 27A shows the guide 308*j* with a guide plate 2786 thereon. FIG. 27B shows the guide 308*j* with the guide plate 2786 removed to reveal the blade 120 and inner components of the guide 308*i*. The blade assembly 102*j* is similar to the blade assembly 102*i* of FIGS. 26A and 26B, except that the ram block 208*j* has guide pins 2784 slidably positionable in guide slots 2785 in the guide, passageways 2769 are in fluid communication with tubes 2792 for passage of fluid therethrough, and trigger 2760 and member 2772 have altered shapes. The passageways 2769 may be provided for releasing fluids, such as mud, that may become trapped in the blade assembly 102*j*. The trigger 2760 has a plunger 2768 with three contacts 2773, 2775 coupled to the member 2772 for activating a release mechanism (or wedges) 2740 in a similar manner as the trigger 2660 of FIGS. 26A and 26B. As shown in FIG. 27A, one of the contacts 2775 extends through the guide plate 2786 and into a pocket 2731 for activation upon contact with a tip of another guide opposite thereto.

The operation as depicted in FIGS. 7-27B show specific sequences of movement and/or configurations of blades, guides and components thereof. Variations in the order of movement and configurations may be provided. For example, the blades and/or guides may be advanced simultaneously or in various order. Various triggers, release mechanisms and/or guides may be provided to achieve the desired movement of the guide during a shearing operations.

Figure 28:
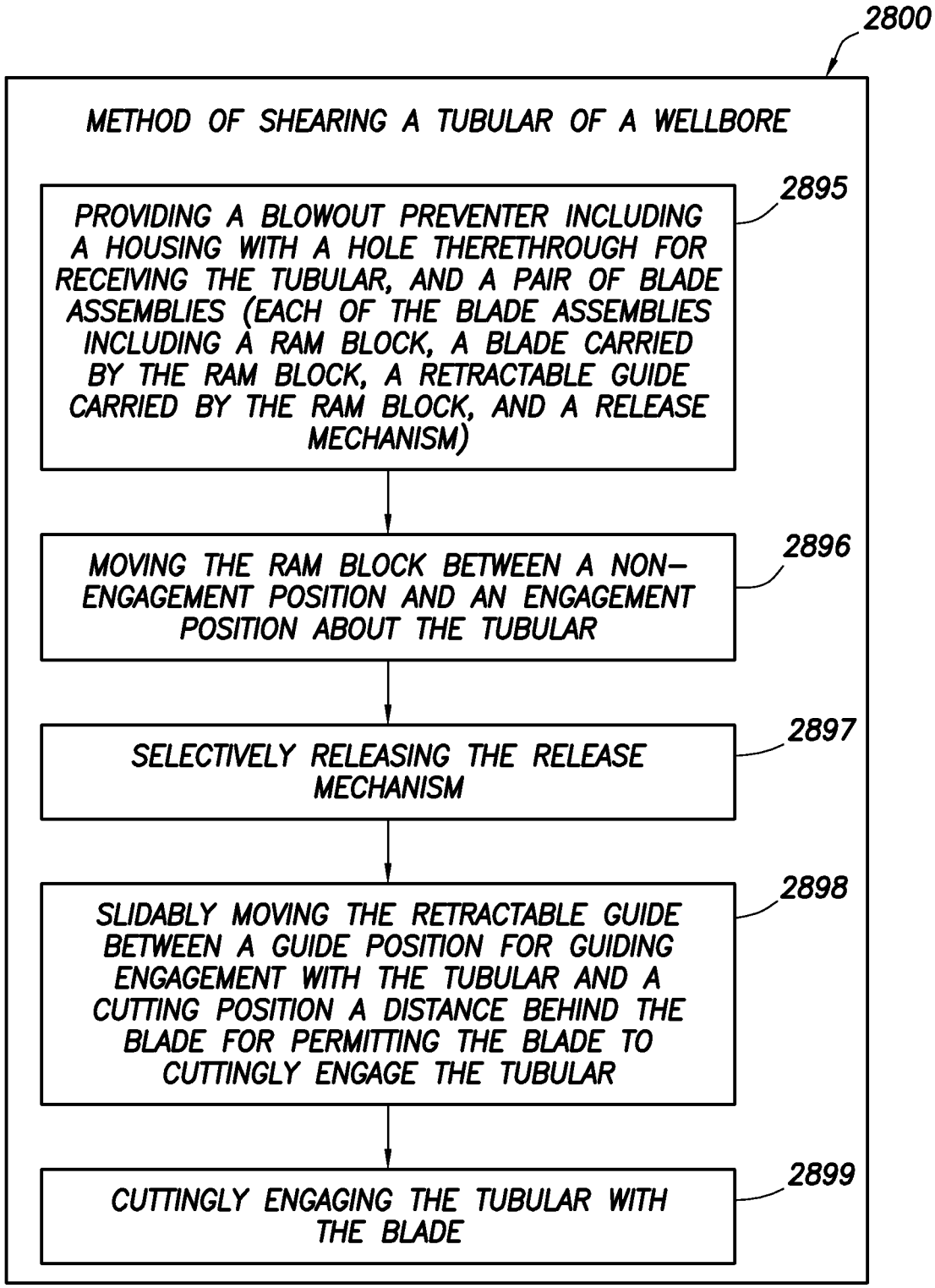
FIG. 28 is a flowchart depicting a method for shearing a tubular of a wellbore.

FIG. 28 depicts a method 2800 of shearing a tubular of a wellbore, such as the wellbore 108 of FIG. 1. The method involves providing 2895 a BOP including a housing with a hole therethrough for receiving the tubular, and a pair of blade assemblies (each of the blade assemblies including a ram block, a blade carried by the ram block, a retractable guide carried by the ram block, and a release mechanism). The method further involving moving 2896 the ram block between a non-engagement position and an engagement position about the tubular, selectively releasing 2897 the release mechanism, slidably moving 2898 the retractable guide between a guide position for guiding engagement with the tubular and a cutting position a distance behind the blade for permitting the blade to cuttingly engage the tubular, and cuttingly 2899 engaging the tubular with the blade. Additional steps may also be performed, such as retracting the blades and/or guides, and the method may be repeated as desired.

It will be appreciated by those skilled in the art that the techniques disclosed herein can be implemented for automated/autonomous applications via software configured with algorithms to perform the desired functions. These aspects can be implemented by programming one or more suitable general-purpose computers having appropriate hardware. The programming may be accomplished through the use of one or more program storage devices readable by the processor(s) and encoding one or more programs of instructions executable by the computer for performing the operations described herein. The program storage device may take the form of, e.g., one or more floppy disks; a CD ROM or other optical disk; a read-only memory chip (ROM); and other forms of the kind well known in the art or subsequently developed. The program of instructions may be "object code," i.e., in binary form that is executable more-or-less directly by the computer; in "source code" that requires compilation or interpretation before execution; or in some intermediate form such as partially compiled code. The precise forms of the program storage device and of the encoding of instructions are immaterial here. Aspects of the invention may also be configured to perform the described functions (via appropriate hardware/software) solely on site and/or remotely controlled via an extended communication (e.g., wireless, internet, satellite, etc.) network.

While the embodiments are described with reference to various implementations and exploitations, it will be understood that these embodiments are illustrative and that the scope of the inventive subject matter is not limited to them. Many variations, modifications, additions and improvements are possible. For example, various combinations of blades (e.g., identical or non-identical), guides, triggers and/or release mechanisms may be provided in various positions (e.g., aligned, inverted) for performing guiding and/or severing operations.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

What is claimed is:

1. A blade assembly of a blowout preventer for shearing a tubular of a wellbore penetrating a subterranean formation, the blowout preventer having a housing with a hole therethrough for receiving the tubular, the blade assembly comprising:

a ram block movable between a non-engagement position and an engagement position about the tubular;

a blade carried by the ram block to cuttingly engage the tubular;

a retractable guide carried by the ram block and slidably movable therealong, the retractable guide having a guide surface guidingly engageable with the tubular; and a release mechanism to selectively release the retractable guide to move along the ram block, the release mechanism comprising a latch operatively connectable to the retractable guide.

2. The blade assembly of claim 1, wherein the release mechanism is activatable by application of a disconnect force to the guide surface thereof.

3. The blade assembly of claim 1, further comprising a trigger for activating the release mechanism.

4. The blade assembly of claim 3, wherein the trigger comprises a plunger operatively connectable to the release mechanism.

5. The blade assembly of claim 4, wherein the plunger is positioned about one of an apex of the guide, along the guide surface of the guide, and combinations thereof.

6. The blade assembly of claim 4, wherein the plunger comprises a plurality of contacts, each of the plurality of contacts operatively coupled to a member by a rod, the member slidably positionable in a trigger channel of the guide.

7. The blade assembly of claim 4, wherein the plunger has at least one trigger guide slidably positionable in at least one trigger slot in the guide.

8. The blade assembly of claim 3, wherein the release mechanism comprises a member operatively coupled to the trigger and slidably positionable in a trigger channel of the guide.

9. The blade assembly of claim 8, wherein the release mechanism further comprises a plurality of biasing members for supporting the member in the guide channel.

10. The blade assembly of claim 8, wherein the release mechanism further comprises a plurality of wedges selectively movable between a locked and unlocked position in the guide by movement of the member.

11. The blade assembly of claim 10, further comprising a plurality of bosses carried by the wedges and selectively movable along a plurality of passageways in the guide.

12. The blade assembly of claim 11, wherein the passageways are in fluid communication with tubes extending through the guide for the passage of fluid therethrough.

13. The blade assembly of claim 2, wherein the release mechanism comprises a lip positionable adjacent an edge of the ram block.

14. The blade assembly of claim 13, wherein the ram block has a ramp for slidingly receiving the lip.

15. The blade assembly of claim 1, wherein the guide comprises a plurality of springs and the release mechanism comprises a plurality of latches releaseably connectable to the plurality of springs.

16. The blade assembly of claim 15, wherein the plurality of latches are pivotally connectable to the ram block for selectively engaging the plurality of springs.

17. The blade assembly of claim 1, wherein the ram blocks have guide pins receivable by guide slots in the guide for sliding movement therealong.

18. The blade assembly of claim 1, wherein the ram blocks have shoulders for slidable engagement with the guide.

19. The blade assembly of claim 1, wherein the guide surface is concave with an apex along a central axis thereof.

20. The blade assembly of claim 1, wherein the guide surface has a first portion at a first angle to the central axis.

21. The blade assembly of claim 20, wherein the guide surface has a second portion at a second angle to the central axis.

22. A blowout preventer for shearing a tubular of a wellbore penetrating a subterranean formation, the blowout preventer comprising:

a housing with a hole therethrough for receiving the tubular; and a pair of blade assemblies, each of the pair of blade assemblies comprising:

a ram block movable between a non-engagement position and an engagement position about the tubular;

a blade carried by the ram block to cuttingly engage the tubular;

a retractable guide carried by the ram block and slidably movable therealong, the retractable guide having a guide surface guidingly engageable with the tubular; and a release mechanism to selectively release the retractable guide to move along the ram block, the release mechanism comprising a latch operatively connectable to the retractable guide.

23. The blowout preventer of claim 22, wherein the retractable guide has a pocket for receiving a tip of another retractable guide positioned opposite thereto.

24. The blowout preventer of claim 22, further comprising at least one actuator for actuating the ram block of each of the plurality of blade assemblies.

25. The blowout preventer of claim 22, wherein the release mechanism comprises a trigger for activation thereof.

26. The blowout preventer of claim 23, wherein the trigger is activatable upon contact with the tubular.

27. The blowout preventer of claim 23, wherein the trigger is activatable upon contact with another guide.

28. A method of shearing a tubular of a wellbore penetrating a subterranean formation, the method comprising:

providing a blowout preventer, comprising:

a housing with a hole therethrough to receive the tubular; and a pair of blade assemblies, each of the pair of blade assemblies comprising:

a ram block;

a blade carried by the ram block;

a retractable guide carried by the ram block; and a release mechanism comprising a latch operatively connectable to the retractable guide;

moving the ram block between a non-engagement position and an engagement position about the tubular;

selectively releasing the retractable guide with the release mechanism;

slidably moving the guide along the ram block; and cuttingly engaging the tubular with the blade.

29. The method of claim 28, wherein the selectively releasing occurs on application of a disconnect force.

30. The method of claim 28, wherein the selectively releasing comprises shifting a lip along a ramp of the ram block.

31. The method of claim 28, wherein the selectively releasing comprises unlatching the retractable guide.

32. The method of claim 28, wherein the selectively releasing comprises triggering the release mechanism.

33. The method of claim 28, wherein the selectively releasing comprises shifting the release mechanism between a locked and an unlocked position.

34. The method of claim 28, further comprising guiding the tubular to a desired position in the blowout preventer with the retractable guide.

35. The blade assembly of claim 1, wherein the retractable guide is positionable in a guide position with the guide surface engageable with the tubular.

36. The blade assembly of claim 1, wherein the retractable guide is positionable in a cutting position with a tip of the blade extending a distance further than the guide surface toward the tubular such that the blade is cuttingly engageable with the tubular.

37. The method of claim 28, further comprising moving the retractable guide to a cutting position such that a tip of the blade extends a distance further toward the tubular than the retractable guide.

* * * * *